US012650004B2

(12) United States Patent
Aoki

(10) Patent No.: US 12,650,004 B2
(45) Date of Patent: Jun. 9, 2026

(54) EXCAVATOR WITH REDUCED BODY SWING ON ROUGH GROUND, AND SUPPORT SYSTEM OF THEREFOR

(71) Applicant: SUMITOMO HEAVY INDUSTRIES, LTD., Tokyo (JP)

(72) Inventor: Yoshinori Aoki, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 294 days.

(21) Appl. No.: 18/473,572

(22) Filed: Sep. 25, 2023

(65) Prior Publication Data

US 2024/0011247 A1 Jan. 11, 2024

Related U.S. Application Data

(63) Continuation of application No. PCT/JP2022/015225, filed on Mar. 28, 2022.

(30) Foreign Application Priority Data

Mar. 29, 2021 (JP) ..... 2021-056037

(51) Int. Cl.
*E02F 9/22* (2006.01)

(52) U.S. Cl.
CPC ..... *E02F 9/2253* (2013.01); *E02F 9/2246* (2013.01)

(58) Field of Classification Search
CPC ..... E02F 9/2253; E02F 9/2246; E02F 9/20
USPC ..... 701/50
See application file for complete search history.

(56) References Cited

U.S. PATENT DOCUMENTS 5,631,835 A * 5/1997 Hagenbuch ..... G07C 5/085 177/136
7,168,709 B2 * 1/2007 Niwa ..... B60G 17/0165 701/1
7,715,963 B2 * 5/2010 Yasui ..... B60G 21/0555 280/5.509
8,406,965 B2 * 3/2013 Ichinose ..... B60P 1/045 340/905
10,519,876 B2 * 12/2019 Srinivasan ..... F02D 41/1406
11,199,853 B1 * 12/2021 Afrouzi ..... B25J 13/006
11,340,079 B1 * 5/2022 Ebrahimi Afrouzi ..... G01C 21/188
11,753,016 B2 * 9/2023 Birkland ..... B60W 10/30 701/50
2008/0133093 A1 * 6/2008 Stanek ..... E02F 9/20 37/468

(Continued)

FOREIGN PATENT DOCUMENTS

JP 2009-106199 5/2009
JP 2016-172963 9/2016

(Continued)

OTHER PUBLICATIONS

International Search Report for PCT/JP2022/015225 mailed on Jun. 14, 2022.

*Primary Examiner* — Andrew R Dyer
(74) *Attorney, Agent, or Firm* — IPUSA, PLLC

(57) ABSTRACT

An excavator includes a traveling body, a traveling hydraulic motor configured to drive the traveling body, and a hardware processor. The hardware processor is configured to, during traveling of the excavator, automatically determine the roughness of a traveling surface on which the traveling body travels and control the traveling hydraulic motor according to the determined roughness.

19 Claims, 13 Drawing Sheets

(56) References Cited

U.S. PATENT DOCUMENTS

| | | | | |
|---|---|---|---|---|
| 2008/0243344 | A1* | 10/2008 | Casey | E02F 3/841 702/56 |
| 2014/0121908 | A1* | 5/2014 | Fehr | G01S 13/82 701/50 |
| 2014/0196919 | A1* | 7/2014 | Kowalchuk | A01B 63/002 701/50 |
| 2014/0358381 | A1* | 12/2014 | Holland | A01C 21/007 701/50 |
| 2015/0230403 | A1* | 8/2015 | Jung | A01D 41/145 701/50 |
| 2015/0305228 | A1* | 10/2015 | Zemenchik | A01B 67/00 172/4 |
| 2019/0063041 | A1* | 2/2019 | Izumi | F02D 29/02 |
| 2019/0135216 | A1* | 5/2019 | Church | G08G 1/165 |
| 2020/0048871 | A1* | 2/2020 | Nishizawa | B60Q 9/008 |
| 2022/0010526 | A1 | 1/2022 | Nishi | |
| 2022/0018095 | A1 | 1/2022 | Doi | |

FOREIGN PATENT DOCUMENTS

| | | |
|---|---|---|
| JP | 2019-190089 | 10/2019 |
| JP | 2020-002751 | 1/2020 |
| JP | 2020-133223 | 8/2020 |
| WO | 2020/203887 | 10/2020 |

* cited by examiner

EXCAVATOR WITH REDUCED BODY SWING ON ROUGH GROUND, AND SUPPORT SYSTEM OF THEREFOR

CROSS-REFERENCE TO RELATED APPLICATION

The present application is a continuation application of International Application No. PCT/JP2022/015225 filed on Mar. 28, 2022, which is based on and claims priority to Japanese Patent Application No. 2021-056037 filed on Mar. 29, 2021. The contents of these applications are incorporated herein by reference in their entirety.

TECHNICAL FIELD

The present disclosure relates to an excavator and a support system of the excavator.

BACKGROUND

A technique for a conventional excavator has been known that restricts movement of the excavator when a state of the excavator is determined to be an unstable state, based on transition of the position of an attachment, information on a current shape of the ground as a work target, and the position of the excavator.

In the conventional technique described above, the state of the excavator caused by the state of the ground (traveling surface) is not mentioned. In the case where the excavator travels on a rough ground at a high speed, the body may swing and damage the body. Further, in conveying work using the conventional technique, there is also a likelihood that loads is dropped by the swing of the body.

Therefore, in view of the above circumstances, it is an object to reduce the swing of the body on a rough ground.

SUMMARY

According to an embodiment in the present disclosure, an excavator includes: a controller including a memory and a processor configured to determine roughness of a traveling surface, wherein the controller controls a hydraulic motor for traveling according to a result of determination of the roughness.

EMBODIMENTS FOR CARRYING OUT THE INVENTION

Embodiments

Figure 1:
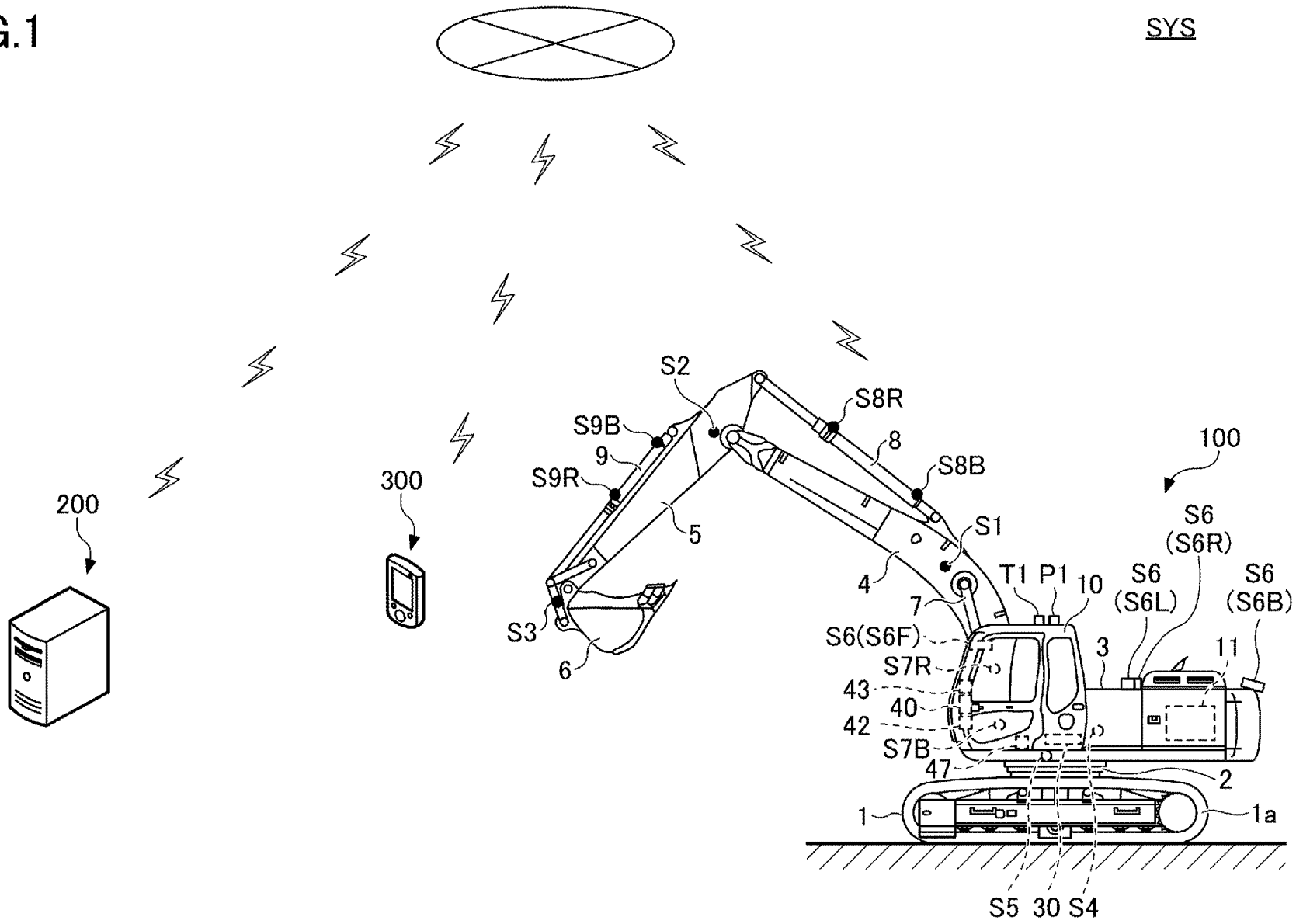
FIG. 1 is a diagram illustrating an example of a system configuration of a support system for an excavator.

In the following, embodiments will be described with reference to the drawings. FIG. 1 is a diagram illustrating an example of a system configuration of a support system for an excavator.

According to an embodiment in the present disclosure, swing of the body of an excavator on the ground in a rough state can be reduced.

An excavator support system SYS according to the present embodiment includes an excavator 100, a management device 200, and a support device 300. In the following description, the support system SYS of the excavator is simply referred to as the support system SYS.

In the support system SYS according to the present embodiment, the excavator 100, the management device 200, and the support device 300 are connected via a network or the like.

The excavator 100 according to the present embodiment determines the state of a traveling surface (ground) on which itself travels, based on change in acceleration detected by an acceleration sensor of itself. In addition, in the case where it is determined that the traveling surface is rough, the excavator 100 executes control to limit the traveling speed. Further, the excavator 100 transmits traveling surface information that includes a result of determining the state of the traveling surface and the positional information on itself to the management device 200.

In addition, the excavator 100 transmits the positional information on itself to the management device 200, and controls the traveling speed according to a command from the management device 200.

In other words, the excavator 100 continuously transmits the positional information on itself to the management device 200, and in the case where it is determined that the traveling surface is in a rough state while traveling, the excavator 100 transmits the result of determining the state of the traveling surface to the management device 200 in association with the positional information.

In response to receiving the traveling surface information from the excavator 100, the management device 200 generates map information using the traveling surface information. In addition, in response to receiving the positional information from the excavator 100, the management device 200 determines the state of the traveling surface on which the excavator 100 is traveling, based on the received positional information and map information. In addition, in the case where it is determined that the state of the traveling surface is rough, the management device 200 instructs the excavator 100 to control the traveling speed.

The support device 300 is a device that supports, for example, an operator who operates the excavator 100, and provides information to the operator by receiving various items of information from the management device 200 or the like and displaying the information on a screen.

Note that in the example in FIG. 1, although the support device 300 is assumed to be included in the support system SYS, it is not limited as such. The support device 300 may not be included in the support system SYS.

In addition, in the example in FIG. 1, although the management device 200 is assumed to be implemented by one information processing device, it is not limited as such. The management device 200 may be implemented by multiple information processing devices. In other words, functions implemented by the management device 200 may be implemented by multiple information processing devices.

In the following, the excavator 100 according to the present embodiment will be described. FIG. 1 illustrates a side view of the excavator 100.

The excavator 100 includes a traveling lower body 1, a revolution mechanism 2, and a revolving upper body 3. In the excavator 100, on the traveling lower body 1, the revolving upper body 3 is installed, which is capable of revolving via the revolution mechanism 2. In addition, a traveling lower body 1 has a crawler belt 1*a* that is a caterpillar (crawler track) rotationally driven by the hydraulic motor for traveling 20. The crawler belt 1*a* has multiple shoe plates.

A boom 4 is attached to the revolving upper body 3. An arm 5 is attached to the tip of the boom 4; and a bucket 6 as an end attachment is attached to the tip of the arm 5.

The boom 4, the arm 5, and the bucket 6 constitute an excavation attachment as an example of an attachment. In addition, the boom 4 is driven by the boom cylinder 7, the arm 5 is driven by the arm cylinder 8, and the bucket 6 is driven by the bucket cylinder 9. A boom angle sensor S1 is attached to the boom 4, an arm angle sensor S2 is attached to the arm 5, and a bucket angle sensor S3 is attached to the bucket 6.

The boom angle sensor S1 is configured to detect the angle of rotation of the boom 4. In the present embodiment, the boom angle sensor S1 is an acceleration sensor and can detect the angle of rotation of the boom 4 with respect to the revolving upper body 3 (hereafter, referred to as the boom angle). The boom angle becomes the minimum angle, for example, when the boom 4 comes to the lowest position, and becomes greater while the boom 4 is raised to a higher position.

The arm angle sensor S2 is configured to detect the angle of rotation of the arm 5. In the present embodiment, the arm angle sensor S2 is an acceleration sensor and can detect the angle of rotation of the arm 5 with respect to the boom 4 (hereafter, referred to as the arm angle). The arm angle becomes the minimum angle, for example, when the arm 5 is closed most, and becomes greater while the arm 5 is opened wider.

The bucket angle sensor S3 is configured to detect the angle of rotation of the bucket 6. In the present embodiment, the bucket angle sensor S3 is an acceleration sensor and can detect the angle of rotation of the bucket 6 with respect to the arm 5 (hereafter, referred to as the arm angle). The bucket becomes the minimum angle, for example, when the bucket 6 is closed most, and becomes greater while the bucket 6 is opened wider.

Each of the boom angle sensor S1, the arm angle sensor S2, and the bucket angle sensor S3 may be a potentiometer using a variable resistor; a stroke sensor for detecting a stroke amount of a corresponding hydraulic cylinder; a rotary encoder for detecting an angle of rotation around a coupling pin; a gyro sensor; a combination of an acceleration sensor and a gyro sensor; or the like.

A boom rod pressure sensor S7R and a boom bottom pressure sensor S7B are attached to the boom cylinder 7. An arm rod pressure sensor S8R and an arm bottom pressure sensor S8B are attached to the arm cylinder 8. A bucket rod pressure sensor S9R and a bucket bottom pressure sensor S9B are attached to the bucket cylinder 9. The boom rod pressure sensor S7R, the boom bottom pressure sensor S7B, the arm rod pressure sensor S8R, the arm bottom pressure sensor S8B, the bucket rod pressure sensor S9R, and the bucket bottom pressure sensor S9B are collectively referred to as the "cylinder pressure sensors".

The boom rod pressure sensor S7R detects the pressure of the oil chamber on the rod side of the boom cylinder 7 (hereafter, referred to as the "boom rod pressure"), and the boom bottom pressure sensor S7B detects the pressure of the oil chamber on the bottom side of the boom cylinder 7 (hereafter, referred to as the "boom bottom pressure"). The arm rod pressure sensor S8R detects the pressure of the oil chamber on the rod side of the arm cylinder 8 (hereafter, referred to as the "arm rod pressure"), and the arm bottom pressure sensor S8B detects the pressure of the oil chamber on the bottom side of the arm cylinder 8 (hereafter, referred to as the "arm bottom pressure").

The bucket rod pressure sensor S9R detects the pressure of the oil chamber on the rod side of the bucket cylinder 9 (hereafter, referred to as the "bucket rod pressure"), and the bucket bottom pressure sensor S9B detects the pressure of the oil chamber on the bottom side of the bucket cylinder 9 (hereafter, referred to as the "bucket bottom pressure").

The revolving upper body 3 is provided with a cabin 10 as the driver's cab, and has a power source such as an engine 11 installed. In addition, a controller 30 (a controller), a display device 40, an input device 42, a sound output device 43, a storage device 47, a positioning device P1, a machine tilt sensor S4, a revolutional angular velocity sensor S5, an imaging device S6, and a communication device Ti are attached to the revolving upper body 3. In the revolving upper body 3, a battery for supplying power and a motor-generator for generating power using the rotational driving power of the engine 11 may be installed. The battery may be, for example, a capacitor or a lithium-ion battery. The motor-generator may function as a motor to drive the mechanical load, or may function as a generator to feed power to the electric load.

The controller 30 functions as a main control unit to control driving the excavator 100. In the present embodiment, the controller 30 is constituted with a computer that includes a CPU, a RAM, a ROM, and the like. Various functions provided by the controller 30 are implemented by, for example, the CPU executing a program stored in the ROM. The various functions includes, for example, at least one of a machine guidance function of guiding a manual operation of the excavator 100 performed by an operator, and a machine control function of automatically supporting a manual operation of the excavator 100 performed by the operator.

The display device 40 is configured to display various items of information. The display device 40 may be connected to the controller 30 via a communication network such as a CAN, or may be connected to the controller 30 via dedicated lines.

The input device 42 is configured to allow an operator to input various items of information into the controller 30. The input device 42 may include, for example, at least one of a touch panel, a knob switch, and a membrane switch installed in the cabin 10.

The sound output device 43 is configured to output sound information. The sound output device 43 may be, for example, an in-vehicle speaker connected to the controller 30 or an alarm such as a buzzer. In the present embodiment, the sound output device 43 is configured to output, by sound, various items of sound information in response to sound output commands from the controller 30.

The storage device 47 is configured to store various items of information. The storage device 47 is, for example, a non-volatile storage medium such as a semiconductor memory. The storage device 47 may store information output by various devices during operations of the excavator 100, and may store information obtained via the various devices before operations of the excavator 100 is started. The storage device 47 may store, for example, data related to a target formation level obtained via the communication device Ti or the like. The target formation level may be set by the operator of the excavator 100, or may be set by a construction manager or the like.

The positioning device P1 is configured to measure the position of the revolving upper body 3. The positioning device P1 may be configured to measure the orientation of the revolving upper body 3. In the present embodiment, the positioning device P1 is, for example, a GNSS compass to detect the position and orientation of the revolving upper body 3, and outputs the detected values to the controller 30. Therefore, the positioning device P1 may also function as an orientation detection device to detect the orientation of the revolving upper body 3. The orientation detection device may be a direction sensor attached to the revolving upper body 3.

The machine tilt sensor S4 is configured to detect the tilt of the revolving upper body 3. In the present embodiment, the machine tilt sensor S4 is an acceleration sensor to detect the tilt angle around the front-and-back axis and the tilt angle around the right-and-left axis of the revolving upper body 3 with respect to a virtual horizontal plane. The front-and-back axis and the right-and-left axis of the revolving upper body 3 are, for example, orthogonal to each other at the center point of the excavator as a point along the pivot of the excavator 100.

The revolutional angular velocity sensor S5 is configured to detect the revolutional angular velocity of the revolving upper body 3. The revolutional angular velocity sensor S5 may be configured to detect or calculate the revolutional angular velocity of the revolving upper body 3. In the present embodiment, the revolutional angular velocity sensor S5 is a gyro sensor. The revolutional angular velocity sensor S5 may be a resolver, a rotary encoder, or the like.

The imaging device S6 is an example of a space recognition device, and configured to obtain images in the surroundings of the excavator 100. In the present embodiment, the imaging device S6 includes a forward camera S6F to capture an image of the space in front of the excavator 100; a left camera S6L to capture an image of the space on the left of the excavator 100; a right camera S6R to capture an image of the space on the right of the excavator 100; and a rear camera S6B to capture an image of the space behind the excavator 100.

The imaging device S6 is, for example, a monocular camera having an imaging element such as a CCD or CMOS, and outputs a captured image to the display device 40. The imaging device S6 may be a stereo camera, a depth image camera, or the like. In addition, the imaging device S6 may be replaced with another space recognition device such as a three-dimensional range image sensor, an ultrasonic sensor, a millimeter wave radar, a LIDAR, or an infrared sensor, or may be replaced with a combination of another space recognition device and a camera.

The forward camera S6F is attached, for example, to the ceiling of the cabin 10, namely, to the inside of the cabin 10. However, the forward camera S6F may be attached to the outside of the cabin 10, such as the roof of the cabin 10 or a side surface of the boom 4. The left camera S6L is attached to the left end on the upper plane of the revolving upper body 3; the right camera S6R is attached to the right end on the upper plane of the revolving upper body 3; and the rear camera S6B is attached to the rear end on the upper plane of the revolving upper body 3.

The space recognition device may be configured to detect objects present in the surroundings of the excavator 100. The object is, for example, a landform shape (inclination, hole, or the like), an electric wire, a utility pole, a person, an animal, a vehicle, a construction machine, a building, a wall, a helmet, a safety vest, work clothes, a predetermined mark on a helmet, or the like. The space recognition device may be configured to be capable of identifying at least one of the type, position, shape, and the like of the object. The space recognition device may be configured to be capable of distinguishing persons from objects other than persons. The space recognition device may be configured to calculate a distance from the space recognition device or the excavator 100 to an object recognized by the space recognition device.

The communication device Tl is configured to control communication with an external device external to the excavator 100. In the present embodiment, the communication device Tl controls communication with the external device via a satellite communication network, a cellular telephone communication network, the Internet, or the like. The external device may be, for example, a management device 200 such as a server installed in an external facility, or a support device 300 such as a smartphone carried by an operator in the surroundings of the excavator 100.

The external device is configured, for example, to be capable of managing construction information on one or more excavators 100. The construction information includes, for example, information on at least one of the working hours, fuel consumption, workload, and the like of the excavator 100. The workload is, for example, the amount of excavated earth and sand, the amount of earth and sand loaded on the loading platform of a dump truck, and the like.

The excavator 100 may be configured to transmit the construction information on the excavator 100 to the external device via the communication device Tl at predetermined time intervals. With this configuration, an operator, a manager, or the like outside the excavator 100 can visually recognize various items of information including the construction information through a display device such as a monitor connected to the management device 200 or the support device 300.

The external device may be a communication device installed on a dump truck equipped with a loaded weight measuring device, or may be a communication device connected to a truck scale that measures the weight of the dump truck. In this case, the excavator 100 can obtain the weight of earth and sand or the like loaded on the loading platform of the dump truck, based on the information from the dump truck or the truck scale.

Figure 2:
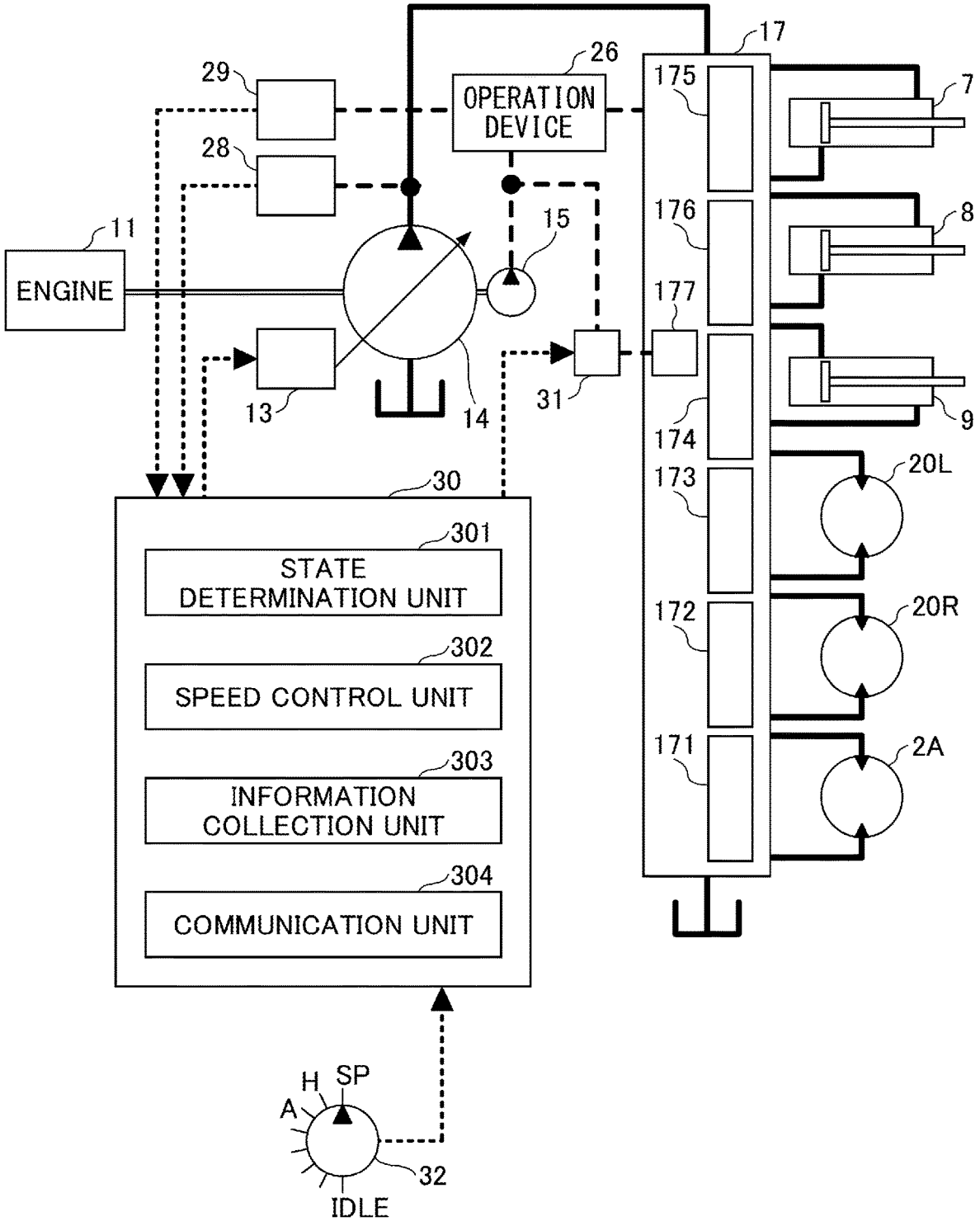
FIG. 2 is a block diagram illustrating an example of a configuration of a drive system of the excavator.

Next, with reference to FIG. 2, a configuration of a drive system of the excavator 100 will be described. FIG. 2 is a block diagram illustrating an example of a configuration of a driving system of the excavator. In FIG. 2, a mechanical power transmission system, high-pressure hydraulic lines, pilot lines, and an electric control system are designated with double lines, bold solid lines, dashed lines, and dotted lines, respectively.

As illustrated in FIG. 2, the driving system of the shovel 100 primarily includes an engine 11, regulators 13, main pumps 14, a pilot pump 15, control valves 17, an operation device 26, discharge pressure sensors 28, operational pressure sensors 29, a controller 30, proportional valves 31, a work mode selection dial 32, and the like.

The engine 11 is the driving source of the excavator. In the present embodiment, the engine 11 is, for example, a diesel engine that operates to maintain a predetermined number of revolutions. In addition, the output shaft of the engine 11 is coupled with the respective input shafts of the main pumps 14 and the pilot pump 15.

The main pump 14 supplies hydraulic oil to the control valves 17 via the high-pressure hydraulic lines. In the present embodiment, the main pump 14 is a swashplate-type, variable-capacity hydraulic pump.

The regulator 13 controls the discharge amount of the main pump 14. In the present embodiment, in response to a control command from the controller 30, the regulator 13 adjusts the tilt angle of the swashplate of the main pump 14, so as to control the discharge amount of the main pump 14.

The pilot pump 15 supplies the hydraulic oil to various hydraulic control devices including the operation device 26 and the proportional valves 31 via the pilot lines. In the present embodiment, the pilot pump 15 is a fixed-capacity hydraulic pump.

The control valves 17 constitute a hydraulic control device that controls the hydraulic system in the excavator. The control valves 17 include control valves 171 to 176 and a breed valve 177. The control valves 17 can selectively supply the hydraulic oil discharged by the main pumps 14 to one or more hydraulic actuators through the control valves 171 to 176.

The control valves 171 to 176 control the flow rate of the hydraulic oil flowing from the main pumps 14 to the hydraulic actuators, and the flow rate of the hydraulic oil flowing from the hydraulic actuators to the hydraulic oil tank. The hydraulic actuators include the boom cylinder 7, the arm cylinder 8, the bucket cylinder 9, a left hydraulic motor for traveling 20L, a right hydraulic motor for traveling 20R, and a hydraulic motor for revolution 2A.

The bleed valve 177 controls a flow rate of the hydraulic oil flowing to the hydraulic oil tank without passing through a hydraulic actuator, among the hydraulic oil discharged by the main pump 14 (hereafter, referred to as the "bleed flow rate"). The bleed valve 177 may be provided outside the control valves 17.

The operation device 26 is a device used by the operator for operating the hydraulic actuators. In the present embodiment, the operation device 26 supplies, via the pilot lines, the hydraulic oil discharged by the pilot pump 15 to the pilot port of a corresponding control valve. The pressure (pilot pressure) of the hydraulic oil supplied to each of the pilot ports is a pressure depending on the operational direction and the operational amount of a lever or a pedal (not illustrated) of the operation device 26 corresponding to each of the hydraulic actuators.

The discharge pressure sensors 28 detects the discharge pressure of the main pumps 14. In the present embodiment, the discharge pressure sensors 28 output the detected values to the controller 30.

The operational pressure sensors 29 detect the contents of an operation performed by the operator using the operation device 26. In the present embodiment, each of the operational pressure sensors 29 detects the operational direction and the operational amount of the lever or pedal of the operation device 26 corresponding to one of the hydraulic actuators in the form of pressure, and outputs the detected value to the controller 30. The contents of an operation on the operation device 26 may be detected using sensors other than the operational pressure sensors.

The controller 30 is a controller that controls the entire excavator 100. Functions of the controller 30 according to the present embodiment will be described in detail later.

The proportional valve 31 operates in response to a control command output by the controller 30. In the present embodiment, the proportional valve 31 is a solenoid valve that adjusts the secondary pressure introduced from the pilot pump 15 to the pilot port of the bleed valve 177 in the control valves 17 in response to a current command output from the controller 30. The proportional valve 31 operates, for example, so as to make the secondary pressure introduced into the pilot port of bleed valve 177 greater, as the current command becomes greater.

The work mode selection dial 32 is a dial for the operator to select a work mode (traveling mode) that allows the operator to make switching among multiple different work modes. In addition, from the work mode selection dial 32, data that indicates the setting state of the number of revolutions of the engine and the setting state of acceleration/deceleration characteristic corresponding to the work mode is constantly transmitted to the controller 30.

The work mode selection dial 32 can switch the work mode in multiple stages including an SP mode, an H mode, an A mode, and an IDLE mode. In other words, the work mode selection dial 32 according to the present embodiment can switch the setting conditions of the excavator 100.

Note that the SP mode is an example of a first mode, and the H mode is an example of a second mode. In addition, FIG. 2 illustrates a state in which the SP mode is selected by the work mode selection dial 32.

The SP mode is a mode to be selected in the case where it is desirable to prioritize the work rate, that uses the highest number of revolutions of the engine and the highest acceleration/deceleration characteristics. The H mode is a mode to be selected in the case where it is desirable to balance the work rate and the fuel efficiency, that uses the second highest number of revolutions of the engine and the second highest acceleration/deceleration characteristics.

The A mode is a mode to improve accurate operability and safety by moderating the acceleration characteristic or the deceleration characteristic of a hydraulic actuator corresponding to a lever operation, and to be selected in the case where it is desirable to operate the shovel with low noise, that uses the third highest number of revolutions of the engine and the third highest acceleration/deceleration characteristics. The IDLE mode is a mode to be selected in the case where it is desirable to shift the engine into an idling state, that uses the lowest number of revolutions of the engine and the lowest acceleration/deceleration characteristics.

The number of revolutions of the engine 11 is controlled to be constant at a number of revolutions of the engine corresponding the work mode selected via the work mode selection dial 32. In addition, the opening of the bleed valve 177 is controlled based on the bleed valve opening characteristic of the work mode set by the work mode selection dial 32. The bleed valve opening characteristic will be described later.

In the present embodiment, each of the work modes described above may be referred to as the setting condition of the excavator 100, and information that represents the setting condition may be referred to as the setting condition information. The setting condition information is information in which a designated item is associated with a value of the item. The designated item is, for example, an item that indicates a state of an number of revolutions of the engine corresponding to each work mode or an item that indicates a state of the acceleration/deceleration characteristic. Therefore, the setting condition information according to the present embodiment includes an item that indicates the state of the number of revolutions of the engine corresponding to each work mode and a value of the item, and an item that indicates the state of the acceleration/deceleration characteristic and a value of the item.

Although an ECO mode is set as one of the modes selected by the work mode selection dial 32 in the configuration diagram in FIG. 2, an ECO mode switch may be provided separately from the work mode selection dial 32. In this case, the number of revolutions of the engine corresponding to each mode selected using the work mode selection dial 32 may be adjusted; in the case where the ECO mode switch is turned on, the acceleration/deceleration characteristic corresponding to each mode of the work mode selection dial 32 may be gradually changed.

In addition, the change in work mode may be implemented by sound input. In this case, the excavator is provided with a sound input device that receives as input sound uttered by the operator to the controller 30. In addition, the controller 30 is provided with a sound recognition unit that distinguishes sounds input through the sound input device.

In this way, the work mode is selected by a mode selection unit that includes the work mode selection dial 32, an ECO mode switch, a sound recognition unit, and the like.

Next, functions of the controller 30 according to the present embodiment will be described. The controller 30 according to the present embodiment includes a state determination unit 301, a speed control unit 302, an information collection unit 303, and a communication unit 304.

The state determination unit 301 determines the state of a traveling surface (ground) on which the excavator 100 travels. Specifically, the state determination unit 301 according to the present embodiment determines whether the absolute value of an amplitude value of acceleration of the body detected by the revolutional angular velocity sensor S5 or the like is greater than or equal to a predetermined threshold value, and in the case where the absolute value of the amplitude value of the acceleration is greater than or equal to the predetermined threshold value, determines that the state of the traveling surface is a rough state having unevenness smaller than the main body of the excavator 100.

In the case where the state determination unit 301 determines that the state of the traveling surface is a rough state, the speed control unit 302 sets the traveling speed of the excavator 100 to a lower speed.

The speed control unit 302 controls the traveling mode of the motor regulator 50. In the present embodiment, the traveling mode includes a forced fixed mode (low-speed mode) and a variable mode (high-speed mode). In the forced fixed mode, the motor volume of the hydraulic motor for traveling 20 is forcibly fixed to a low-rotation setting. In the variable mode, the motor volume is in a state switchable between the low-rotation setting and a high-rotation setting. The traveling mode may include a manual fixed mode. The manual fixed mode is, for example, a traveling mode set by using the switch 31. In the manual fixed mode, the motor volume is fixed to the low-rotation setting as in the case of the forced fixed mode.

For example, in the case where a predetermined condition is satisfied, the speed control unit 302 outputs a command to the solenoid valve 27 to communicate the control pump 15 with the motor regulator 50. In the case where the control pump 15 and the motor regulator 50 communicate with each other, the motor regulator 50 operates in the forced fixed mode. In this case, the left motor controller 50L fixes the motor volume of the left hydraulic motor for traveling 20L to the low-rotation setting, and the right motor controller 50R fixes the motor volume of the right hydraulic motor for traveling 20R to the low-rotation setting.

The information collection unit 303 collects traveling surface information in which the positional information that represents the position of the excavator 100, a determination result by the state determination unit 301, and a work mode of the excavator 100 are associated with each other. The traveling surface information is stored in the storage device 47 or the like.

The communication unit 304 transmits and receives information between the excavator 100 and an external device. Specifically, the communication unit 304 transmits the traveling surface information collected by the information collection unit 303 to the management device 200.

Figure 3:
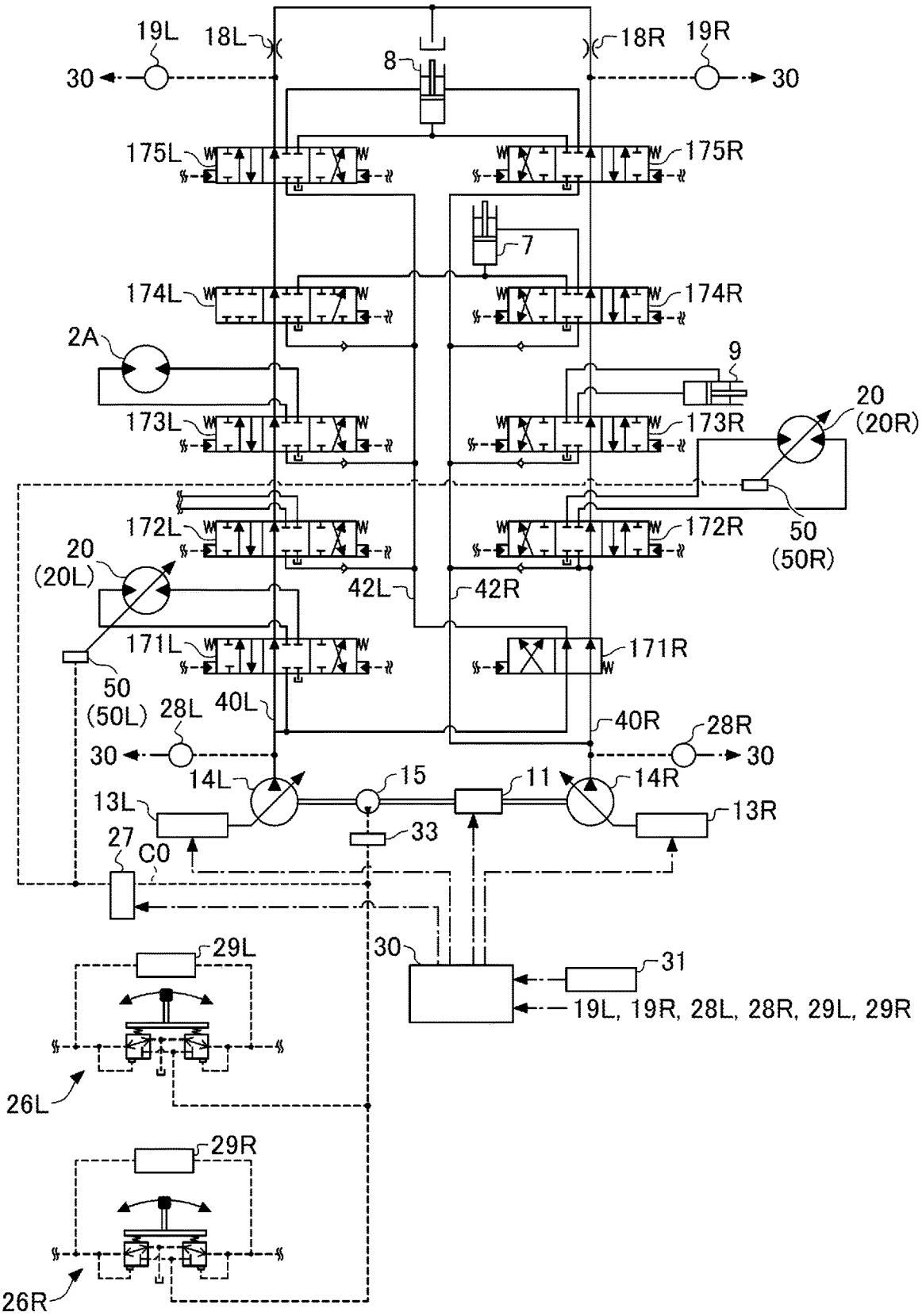
FIG. 3 is a schematic diagram illustrating an example of a configuration of a hydraulic system installed on the excavator.

Next, with reference to FIG. 3, the hydraulic system installed on the excavator 100 will be described. FIG. 3 is a schematic diagram illustrating an example of a configuration of the hydraulic system installed on the excavator. The hydraulic system in FIG. 3 circulates the hydraulic oil from the main pumps 14L and 14R driven by the engine 11 to the hydraulic oil tank via center bypass pipelines 40L and 40R, and parallel pipelines 42L and 42R. The main pumps 14L and 14R correspond to the main pump 14 in FIG. 3.

The left center bypass pipeline 40L is a hydraulic oil line passing through the control valves 171L to 175L arranged in the control valves 17. The right center bypass pipeline 40R is a hydraulic oil line passing through the control valves 171R to 175R arranged in the control valves 17.

The control valve 171L is a spool valve to supply the hydraulic oil discharged by the main pump 14L to the left hydraulic motor for traveling 20L, and to switch the flow of the hydraulic oil discharged by the left hydraulic motor for traveling so as to discharge the hydraulic oil into the hydraulic oil tank.

The control valve 171R is a spool valve as a straight travel valve. The control valve 171R switches the flow of the hydraulic oil so as to supply the hydraulic oil from the left main pump 14L to each of the left hydraulic motor for traveling and the right hydraulic motor for traveling 20R, in order to increase the straightness of the traveling lower body 1.

Specifically, in the case where the hydraulic motor for traveling 20 and any of the other hydraulic actuators are operated at the same time, the control valve 171R is switched so that the main pump 14L can supply the hydraulic oil to both the left hydraulic motor for traveling 20L and the right hydraulic motor for traveling 20R. In the case where none of the other hydraulic actuators is operated, the control valve 171R is switched so that the main pump 14L can supply the hydraulic oil to the left hydraulic motor for traveling 20L, and the main pump 14R can supply the hydraulic oil to the right hydraulic motor for traveling 20R.

The control valve 172L is a spool valve to supply the hydraulic oil discharged by the main pump 14L to an optional hydraulic actuator, and to switch the flow of the hydraulic oil discharged by the optional hydraulic actuator so as to discharge the hydraulic oil into the hydraulic oil tank. The optional hydraulic actuator is, for example, a grapple open/close cylinder.

The control valve 172R is a spool valve to supply the hydraulic oil discharged by the main pump 14R to the right hydraulic motor for traveling 20R, and to switch the flow of the hydraulic oil discharged by the hydraulic motor for traveling 20R so as to discharge the hydraulic oil into the hydraulic oil tank.

The control valve 173L is a spool valve to supply the hydraulic oil discharged by the main pump 14L to the hydraulic motor for revolution 2A, and to switch the flow of the hydraulic oil discharged by the hydraulic motor for revolution 2A so as to discharge the hydraulic oil into the hydraulic oil tank.

The control valve 173R is a spool valve to supply the hydraulic oil discharged by the main pump 14R to the end attachment cylinder 9, and to discharge the hydraulic oil in the end attachment cylinder 9 into the hydraulic oil tank.

The control valves 174L and 174R are spool valves to supply the hydraulic oil discharged by the main pumps 14L and 14R to the boom cylinder 7, and to switch the flow of the hydraulic oil so as to discharge the hydraulic oil in the boom cylinder 7 into the hydraulic oil tank. In the present embodiment, the control valve 174L operates only in the case where an up operation of the boom 4 is executed, and does not operate in the case where a down operation of the boom 4 is executed.

The control valves 175L and 175R are spool valves to supply the hydraulic oil discharged by the main pumps 14L and 14R to the arm cylinder 8, and to switch the flow of the hydraulic oil so as to discharge the hydraulic oil in the arm cylinder 8 into the hydraulic oil tank.

The parallel pipeline 42L is a hydraulic oil line parallel to the center bypass pipeline 40L. The parallel pipeline 42L can supply the hydraulic oil to a further downstream control valve in the case where the flow of the hydraulic oil through the center bypass pipeline 40L is restricted or cut off by any of the control valves 171L to 174L. The parallel pipeline 42R is a hydraulic oil line parallel to the center bypass pipeline 40R. The parallel pipeline 42R can supply the hydraulic oil to a further downstream control valve in the case where the flow of the hydraulic oil through the center bypass pipeline 40R is restricted or cut off by one of the control valves 172R to 174R.

The pump regulators 13L and 13R adjust the tilt angles of the swashplates of the main pumps 14L and 14R, respectively, in response to the respective discharge pressure of the main pumps 14L and 14R, so as to control the discharge amounts of the main pumps 14L and 14R. The pump regulators 13L and 13R correspond to the pump regulator 13 in FIG. 3. The pump regulator 13L or 13R adjusts the tilt angle of the swashplate of the main pump 14L or 14R, for example, in the case of an increase in the discharge pressure of the main pump 14L or 14R, so as to reduce the discharge amount. This is to control the absorbed horsepower of the main pump 14, which is expressed by a product of the discharge pressure and the discharge volume, so as not to exceed the output horsepower of the engine 11.

The left traveling operation device 26L and the right traveling operation device 26R are examples of the operation device 26. In the present embodiment, it is configured with a combination of a traveling operation lever and a traveling operation pedal.

The left traveling operation device 26L is used for operating the left hydraulic motor for traveling 20L. The left traveling operation device 26L applies a pilot pressure corresponding to the amount of operation to the pilot port of the control valve 171L by using the hydraulic oil discharged by the control pump 15. Specifically, the left traveling operation device 26L causes the pilot pressure to act on the left-side pilot port of the control valve 171L in the case of being operated in the forward direction, and causes the pilot pressure to act on the right-side pilot port of the control valve 171L in the case of being operated in the backward direction.

The right traveling operation device 26R is used for operating the right hydraulic motor for traveling 20R. The right traveling operation device 26R applies a pilot pressure corresponding to the amount of operation to the pilot port of the control valve 172R by using the hydraulic oil discharged by the control pump 15. Specifically, the right traveling operation device 26R causes the pilot pressure to act on the right pilot port of the control valve 172R in the case of being operated in the forward direction, and causes the pilot pressure to act on the left pilot port of the control valve 172R in the case of being operated in the backward direction.

The solenoid valve 27 causes the control pump 15 to communicate with the motor regulator 50 in the case of receiving a communication command from the controller 30. In this case, the motor regulator 50 operates in a forced fixed mode. On the other hand, in the case of not receiving a communication command from the controller 30, the solenoid valve 27 cuts off communication between the control pump 15 and the motor regulator 50. In this case, the motor regulator 50 operates in a variable mode.

The pressure reducing valve 33 controls a stroke amount (movement amount) of a spool included in each of the control valves 171L and 172R in response to a command from the controller 30. In the present embodiment, in the case where a flow rate reduction process is executed by the hydraulic motor for traveling 20, the main pump 14, the engine 11, and the like, the pressure reducing valve 33 is not necessarily required.

The discharge pressure sensors 28L and 28R are examples of the discharge pressure sensor 28 in FIG. 3. The discharge pressure sensor 28L detects the discharge pressure of the main pump 14L, and outputs the detected value to the controller 30. The discharge pressure sensor 28R detects the discharge pressure of the main pump 14R, and outputs the detected value to the controller 30.

The operation pressure sensors 29L and 29R are examples of the operation pressure sensor 29 in FIG. 3. The operation pressure sensor 29L detects the contents of an operation performed by the operator on the left traveling operation device 26L in the form of pressure, and outputs the detected value to the controller 30. The operation pressure sensor 29R detects the contents of an operation performed by the operator on the right traveling operation device 26R in the form of pressure, and outputs the detected value to the controller 30. The contents of an operation is, for example, the operational direction, the operational amount (the operation angle), or the like.

A boom operation lever, an arm operation lever, a bucket operation lever, and a revolution operation lever (none of these illustrated) are operation devices for operating up and down the boom 4, opening and closing the arm 5, opening and closing the bucket 6, and revolving the revolving upper body 3, respectively. Like the left traveling operation device 26L, these operation devices use the hydraulic oil discharged by the control pump 15 to apply a pilot pressure corresponding to the amount of lever operation to either the left or right pilot port of a control valve corresponding to each of the hydraulic actuators.

In addition, an operation content of the operator on each of these operation devices is detected in the form of pressure by the corresponding operation pressure sensor in substantially the same way as by the operation pressure sensor 29L, and the detected value is output to the controller 30.

In addition, the operation devices 26 (the left traveling operation device 26L, the right traveling operation device 26R, the left traveling lever 26DL, the right traveling lever 26DR, etc.) may be of an electric type that outputs an electric signal (hereafter, referred to as "operation signal") instead of a hydraulic pilot type that outputs a pilot pressure. In this case, the electric signal (operation signal) from the operation device 26 is input into the controller 30, the controller 30 controls each of the control valves 171 to 175 in the control valves 17 according to the input electric signal, and thereby, operations of various hydraulic actuators are implemented according to the operation content on the operation device 26. For example, the control valves 171 to 175 in the control valves 17 may be electromagnetic solenoid spool valves that are driven by commands from the controller 30. In addition, for example, between the control pump 15 and the pilot port of each of the control valves 171 to 175, a hydraulic control valve (hereafter, referred to as an "operation control valve") that operates in response to an electric signal from the controller 30 may be arranged. The operation control valve may be, for example, a proportional valve. In this case, in the case where a manual operation using an electric operation device 26 is executed, the controller 30 controls the operation control valve by an electric signal corresponding to the amount of operation (e.g., an amount of lever operation) to increase or decrease the pilot pressure, and thereby, can cause each of the control valves 171 to 175 to operate according to the operation content on the operation device 26.

Here, negative control adopted in the hydraulic system in FIG. 3 (hereafter, also referred to as "negacon control") will be described.

The center bypass pipelines 40L and 40R are provided with negative control throttles 18L and 18R, respectively, between the respective control valves 175L and 175R located most downstream, and the hydraulic oil tank. The flows of the hydraulic oil discharged by the main pumps 14L and 14R are restricted by the negative control throttles 18L and 18R, respectively. In addition, the negative control throttles 18L and 18R generate control pressures for controlling the pump regulators 13L and 13R, respectively (hereafter, also referred to as "negacon pressures").

The negative control pressure sensors 19L and 19R are sensors for detecting the control pressures generated upstream of the negative control throttles 18L and 18R, respectively. In the present embodiment, the negative control pressure sensors 19L and 19R output respective detected values to the controller 30.

The controller 30 outputs commands corresponding to the negative control pressures to the pump regulators 13L and 13R. In response to the commands, the pump regulators 13L and 13R adjust the respective tilt angles of the swashplates of the main pumps 14L and 14R, so as to control the discharge amounts of the main pumps 14L and 14R. Specifically, the pump regulators 13L and 13R decrease the respective discharge amounts of the main pumps 14L and 14R while the negative control pressure becomes greater, and increase the discharge amounts of the main pumps 14L and 14R while the negative control pressure becomes smaller.

In a case where none of the hydraulic actuators is being operated, the hydraulic oil discharged by the main pumps 14L and 14R reaches the negative control throttles 18L and 18R through the center bypass pipelines 40L and 40R, respectively. Then, the flows of the hydraulic oil discharged by the main pumps 14L and 14R increase the negative control pressures generated upstream of the negative control throttles 18L and 18R, respectively. As a result, the pump regulators 13L and 13R decrease the discharge amounts of the main pumps 14L and 14R, respectively, down to the minimum allowable discharge amount, to suppress pressure loss (pumping loss) when the discharged hydraulic oil passes through the center bypass pipelines 40L and 40R, respectively.

On the other hand, in the case where one of the hydraulic actuators is being operated, the hydraulic oil discharged by the main pumps 14L and 14R flows into a hydraulic actuator to be operated through a control valve corresponding to the hydraulic actuator to be operated. Then, the flows of the hydraulic oil discharged by the main pumps 14L and 14R reduce or eliminate the amounts to reach the negative control throttles 18L and 18R, respectively, which reduce the negative control pressures generated upstream of the negative control throttles 18L and 18R, respectively. As a result, the pump regulators 13L and 13R increase the discharge amounts of the main pumps 14L and 14R, to cause a sufficient amount of the hydraulic oil to circulate in the hydraulic actuator to be operated, so as to securely drive the hydraulic actuator to be operated.

With the configuration as described above, the hydraulic system in FIG. 3 can suppress wasteful energy consumption in each of the main pumps 14L and 14R in the case where none of the hydraulic actuators is being operated. The wasteful energy consumption includes pumping loss generated in the center bypass pipelines 40L and 40R by the hydraulic oil discharged by the main pumps 14L and 14R. In the case where a hydraulic actuator is being operated, it is configured to securely supply a necessary and sufficient amount of the hydraulic oil from each of the main pumps 14L and 14R to the hydraulic actuator to be operated.

Figure 4:
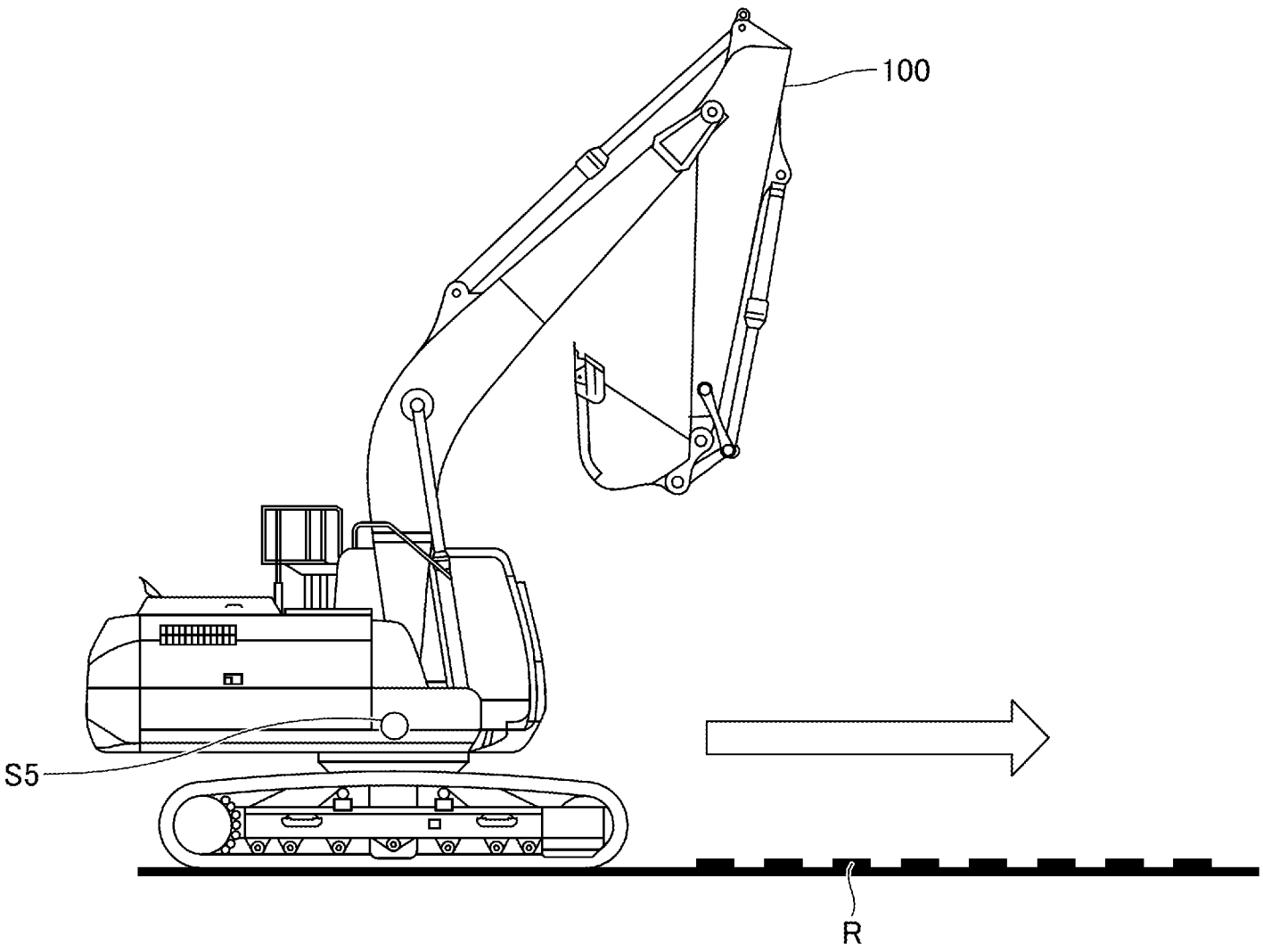
FIG. 4 is a diagram illustrating an overview of operations of the excavator.

Next, with reference to FIGS. 4 and 5, an overview of operations of the excavator 100 according to the present embodiment will be described. FIG. 4 is a diagram illustrating an overview of operations of the excavator.

A ground R illustrated in FIG. 4 is assumed to be in a rough state in which unevenness due to gravel (stones), quarrying, grooves, and the like is present although the sizes of these objects are smaller than the main body of the excavator 100. In the case where the excavator 100 travels on the ground R, the body is continuously swung, and the change in acceleration of the body becomes great. In other words, in the case where the ground R (traveling surface) is in a rough state, the amplitude value of acceleration detected by the acceleration sensor of the excavator 100 becomes great.

Note that it is favorable to provide the acceleration sensor of the excavator 100 at a position being the pivot of the revolving upper body 3 and the revolution mechanism 2, and the revolutional angular velocity sensor S5 or the like may be used.

In addition, in the following description, a state of a traveling surface in which the amplitude value of acceleration (absolute value) is greater than or equal to a predetermined threshold value may be referred to as a rough state, and a state of a traveling surface in which the amplitude value of acceleration (absolute value) is less than the predetermined threshold value may be referred to as a smooth state or a soft state.

In other words, the rough state of a traveling surface is a state (first state) in which speed control by the speed control unit 302 is required, and the smooth state or the soft state of a traveling surface is a state (second state) in which speed control by the speed control unit 302 is not required.

In addition, in the present embodiment, unevenness having a height difference smaller than the height of the crawler belt 1*a* is regarded as a state of the traveling surface to be determined by the state determination unit 301. In addition, in the present embodiment, the degree of roughness of a traveling surface may be determined based on the amplitude value of acceleration detected by the acceleration sensor of the excavator 100. In addition, in the present embodiment, the controller 30 may limit the traveling speed of the excavator 100 in response to the determined degree of roughness of the traveling surface. For example, the gravel (stones) present in the ground varies in size. Therefore, in the present embodiment, depending on the sizes of the stones, the degree of roughness of the traveling surface may be determined. In addition, the degree of roughness of the traveling surface may have multiple levels. In addition, the multiple levels may be three or more levels, and in this case, the traveling speed of the excavator 100 may also be limited according to the three or more levels. For example, assume that large stones (having a diameter of 64 mm or greater) and small stones (having a diameter of less than 64 mm) are present on the ground. In this case, in the present embodiment, it is determined that the degree of roughness is greater for a traveling surface on which stones having greater diameters are present than a traveling surface on which stones having smaller diameters are present. In addition, the controller 30 may limit the traveling speed of the excavator 100 on a traveling surface having a greater degree of roughness to be lower than the traveling speed of the excavator 100 on a traveling surface having a smaller degree of roughness. Further, the excavator 100 according to the present embodiment may transmit information that represents the degree of roughness of a traveling surface to the management device 200 as part of the traveling surface information together with the positional information on the traveling surface. In response to receiving this information, the management device 200 reflects the position of the traveling surface and the degree of roughness of the traveling surface in construction planning drawings. In the present embodiment, by reflecting the state of the traveling surface in the construction planning drawings in this way, excavators 100 other than the excavator 100 can share the information that represents the state of the traveling surface. Note that the degree of roughness of the traveling surface may be determined by a measure other than the amplitude value of acceleration. Specifically, the degree of roughness of the traveling surface may be determined based on a result of analyzing an image of the traveling surface captured by the imaging device S6.

Figure 5A:
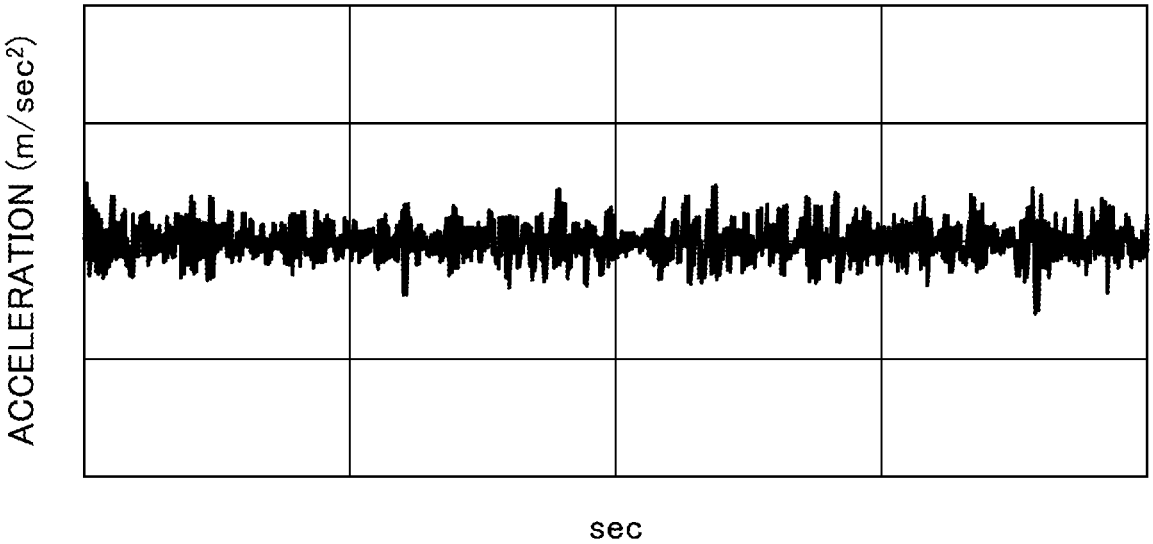
FIGS. 5A-5B are first diagrams illustrating change in acceleration of the excavator.
Figure 5B:
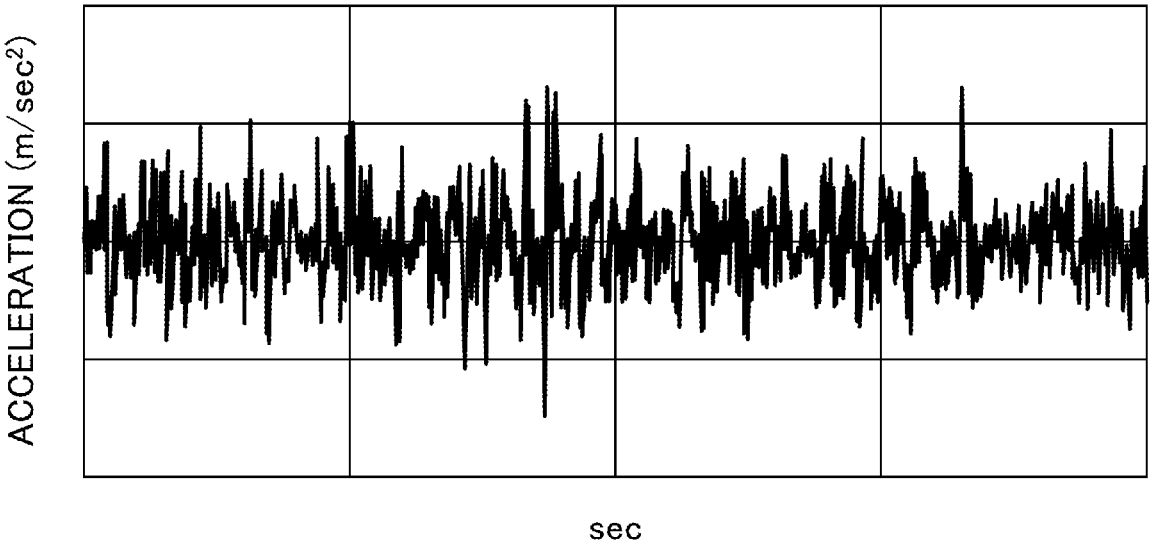

In the following, with reference to FIGS. 5A-5B, change in acceleration of the excavator 100 will be described. FIGS. 5A-5B are first diagrams illustrating change in acceleration. FIG. 5A is a diagram illustrating an example of change in acceleration when the excavator 100 is traveling on a traveling surface in a smooth state or a soft state. FIG. 5B is a diagram illustrating an example of change in acceleration when the excavator 100 is traveling on a traveling surface in a rough state.

As can be seen from FIGS. 5A-5B, the amplitude value of acceleration (absolute value) when the excavator 100 is traveling on a traveling surface in a rough state is greater than the amplitude value of acceleration (absolute value) when the excavator 100 is traveling on a traveling surface in a smooth state or a soft state.

Note that the case where the waveform of acceleration is as illustrated in FIG. 5A is a case where the excavator 100 travels on a flat (smooth) traveling surface with little gravel, unevenness, or the like. In the case where the traveling surface is flat, the change in acceleration of the excavator 100 does not depend on the hardness of the traveling surface or the traveling mode, and is small to the extent illustrated in FIG. 5A. In the case where the work site is a sandy soil, paved surface, or the like, the traveling surface is determined to have a relatively flat (smooth) degree of roughness.

In addition, the case where the waveform of acceleration is as illustrated in FIG. 5A is the case when the excavator 100 is traveling on an uneven but soft traveling surface. In the case where the traveling surface is soft earth and sand or the like, the change in acceleration of the excavator 100 is expected to be small to the extent illustrated in FIG. 5A even if there are some unevenness, earth and sand, or the like.

In addition, the case where the waveform of acceleration is as illustrated in FIG. 5B is a case where the excavator 100 is traveling on a traveling surface in a rough state where there is gravel, unevenness, and the like. In addition, the change in acceleration of the excavator 100 becomes greater as the traveling speed of the excavator 100 becomes greater.

In a state as illustrated in FIG. 5B, the body of the excavator 100 is greatly swung. As a result, when the shoe plates constituting the crawler belt 1*a* of the traveling lower body 1 come into contact with the traveling surface, the shoe plates are struck against the traveling surface, which may affect the progress of deterioration of the structure.

Therefore, in the present embodiment, a predetermined threshold value is set for the amplitude value of acceleration (absolute value) of the excavator 100, and when the amplitude value of acceleration becomes greater than or equal to the predetermined threshold value, the speed of the excavator 100 is limited.

Figure 6:
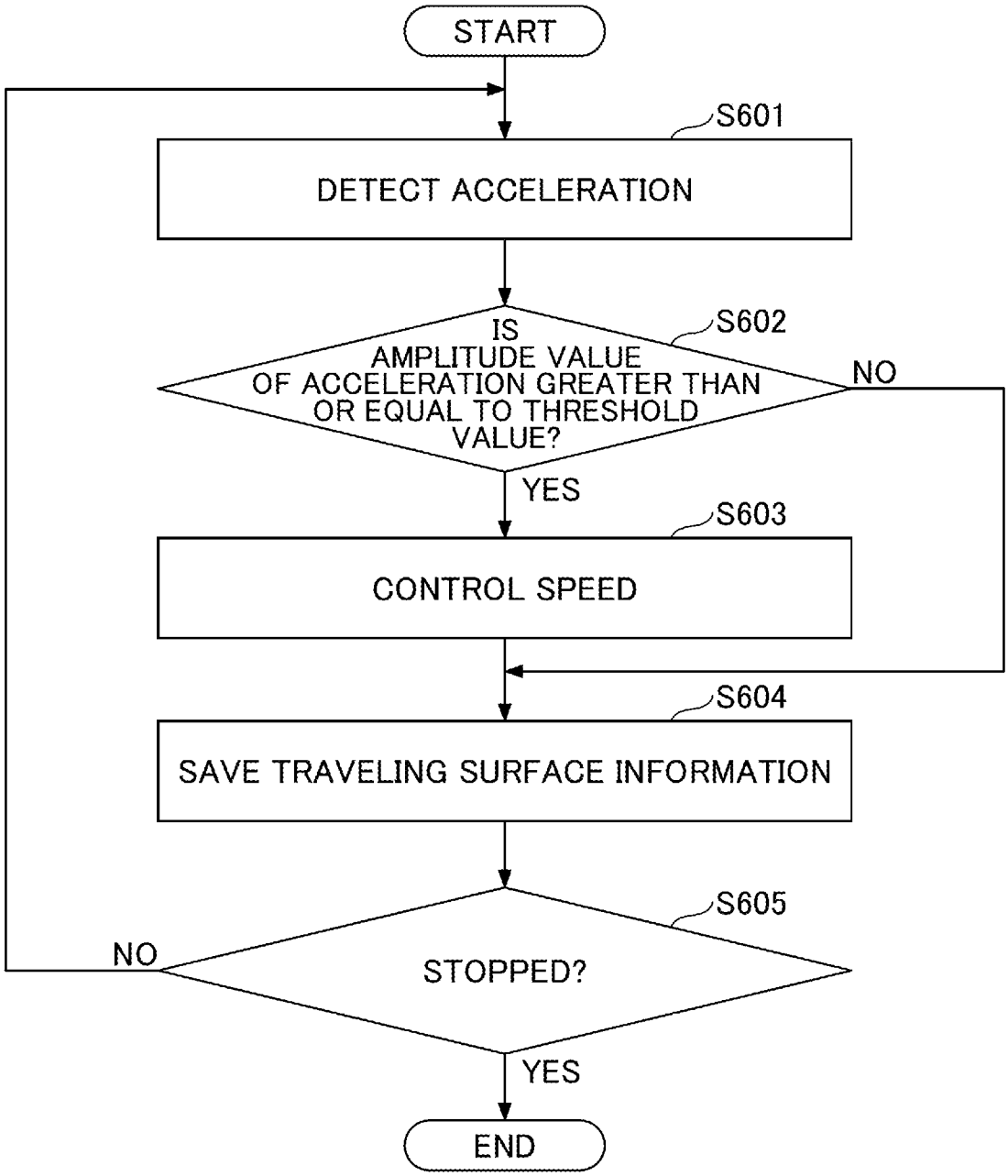
FIG. 6 is a flow chart illustrating operations of an excavator of an embodiment.

In the following, with reference to FIG. 6, operations of the excavator 100 according to the present embodiment will be described. FIG. 6 is a flow chart illustrating operations of the excavator.

The excavator 100 according to the present embodiment detects acceleration by the revolutional angular velocity sensor S5 or the like (Step S601). In other words, the controller 30 obtains a value of the acceleration detected by the revolutional angular velocity sensor S5 or the like by the state determination unit 301.

Next, the controller 30 determines by the state determination unit 301 whether the absolute amplitude value of acceleration is greater than or equal to the predetermined value (Step S602). In other words, here, the state determination unit 301 determines whether the traveling surface on which the excavator 100 is traveling is a rough state.

Note that the predetermined threshold may be a value set in advance, may be set upon factory shipment of the excavator 100, or may be set by a manager or the like of the excavator 100.

At Step S602, if the amplitude value of acceleration is less than the predetermined value, the excavator 100 proceeds to Step S604 that will be described later.

At Step S602, if the amplitude value of acceleration is greater than or equal to the predetermined threshold value, the controller 30 causes the speed control unit 302 to execute control of limiting the traveling speed of the excavator 100 (Step S603).

Specifically, the speed control unit 302 may switch the traveling mode of the excavator 100 from a high-speed mode to a low-speed mode. In addition, the speed control unit 302 may limit the upper limit of the traveling speed of the excavator 100, by controlling the control valves 171 and 172 to control the flow rate of the hydraulic oil.

In this case, for example, in the case where an operation control valve (proportional valve) that operates in response to an electric signal from the controller 30 is arranged between the control pump 15 and pilot ports of the control valves 171L and R, the speed control unit 302 may control the operation control valve in response to the determination result of the state determination unit 301. Further, in the case where an electromagnetic solenoid spool valve is used as the control valves 171L and R, the speed control unit 302 may control the electromagnetic solenoid spool valve according to the determination result of the state determination unit 301. In this way, operation control valves, electromagnetic solenoid spool valves, and the like can also be used for changing the driving force of the hydraulic motor for traveling.

In other words, at Step S603, the speed control unit 302 may control the traveling speed of the excavator 100 to be lower than the current traveling speed.

Next, the controller 30 collects and stores the traveling surface information by the information collection unit 303 (Step S604). Specifically, the information collection unit 303 generates traveling surface information in which a determination result of the state of a traveling surface obtained by the state determination unit 301 is associated with positional information that represents the current position of the excavator 100, and stores the traveling surface information in the storage device 47 or the like.

Note that the information collection unit 303 may set, as the traveling surface information, information in which a determination result of the state of a traveling surface, the positional information on the excavator 100, and the speed information that represents the traveling speed of the excavator 100 after the speed control by the speed control unit 302 are associated with each other.

Next, the controller 30 determines whether the excavator 100 has stopped traveling (Step S605). At Step S605, in the case where the excavator 100 does not stop traveling, i.e., in the case where the excavator 100 is traveling, the controller 30 returns to Step S601.

At Step S605, in the case where the traveling is stopped, the controller 30 ends the process.

In the present embodiment, in this way, the state of the traveling surface on which the excavator 100 is traveling is determined depending on the change in acceleration of the excavator 100. In addition, in the present embodiment, in the case where the traveling surface is determined to be in a rough state, the traveling speed of the excavator 100 is reduced.

Therefore, according to the present embodiment, the change in acceleration of the excavator 100 in an area where the traveling surface is rough can be automatically reduced. In addition, according to the present embodiment, by reducing the change in acceleration, the swing of the body of the excavator 100 can be suppressed, the fatigue or the like of the operator can be reduced, and the riding comfort can be improved.

Further, in the present embodiment, the shock to the structure is reduced by suppressing the swing of the body; therefore, the influence on the progress of deterioration of the body can be reduced.

In addition, in the present embodiment, in the case where it is determined that a traveling surface is rough, traveling surface information including positional information on the excavator 100 when the determination is made is collected and stored.

Therefore, in the present embodiment, by controlling the traveling speed of the excavator 100 based on the traveling surface information when the excavator 100 travels again in an area where the excavator 100 has traveled once, the excavator 100 can travel on the traveling surface in a rough state while maintaining a state of the amplitude value of acceleration of the excavator 100 being less than the predetermined threshold value.

Specifically, for example, in the present embodiment, in the case where the traveling surface information is stored in the storage device 47, the traveling speed of the excavator 100 may be reduced before the positional information indicated by the traveling surface information is reached. In this way, by referring to the traveling surface information, even in the case of traveling on a rough traveling surface, it is possible to cause the excavator 100 to travel so as to suppress the swing of the body.

In addition, in the present embodiment, the traveling surface information may be shared with other excavators 100. Specifically, the excavator 100 may transmit the traveling surface information to other excavators 100 present in the same work site. In addition, in the case where the excavator 100 receives the traveling surface information from another excavator 100, the excavator 100 may store the received traveling surface information in the storage device 47.

In this way, in the present embodiment, by holding the traveling surface information collected by the other excavators 100, even in an area where the excavator 100 has not traveled, the excavator 100 can travel so as to suppress the swing of the body, and the riding comfort of the operator can be improved.

Figure 7:
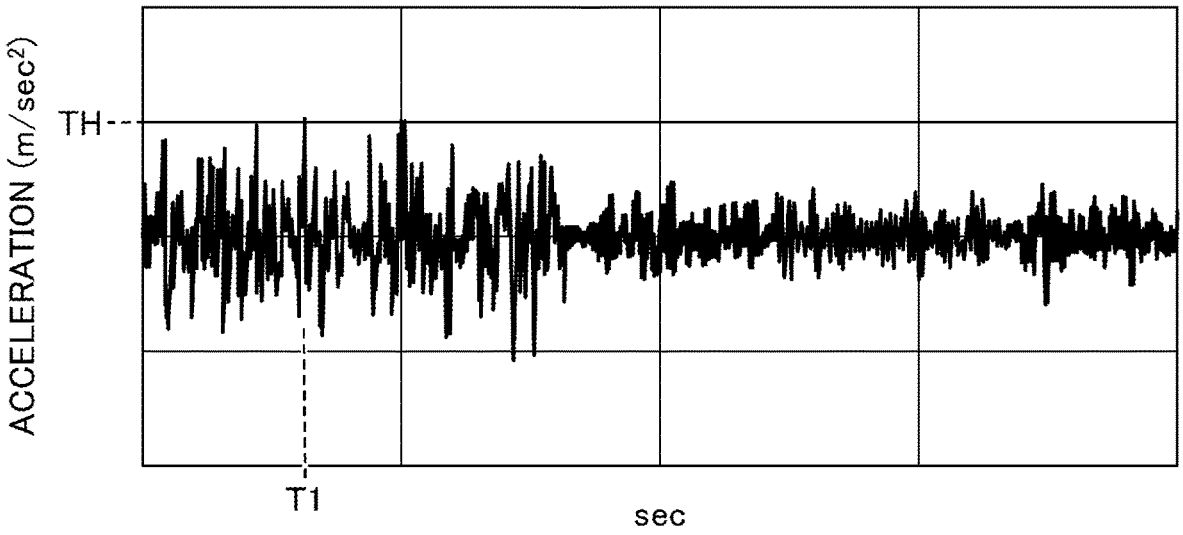
FIG. 7 is a second diagram illustrating change in acceleration of the excavator.

In the following, with reference to FIG. 7, change in acceleration of the excavator 100 in the case of applying the present embodiment will be described. FIG. 7 is a second diagram illustrating change in acceleration of the excavator.

In the example in FIG. 7, the amplitude value of acceleration becomes greater than or equal to a predetermined threshold value TH at the time Tl while traveling in the high-speed mode.

In this case, at the time Tl, the controller 30 determines that the traveling surface is in a rough state, and reduces the traveling speed of the excavator 100. In the example in FIG. 7, it can be seen that after the traveling speed is reduced, the amplitude value of acceleration becomes less than the predetermined threshold value TH, and the amplitude value gradually decreases.

Therefore, according to the present embodiment, even in the case where the excavator 100 travels in a place where a traveling surface is rough, the swing of the body of the excavator 100 can be suppressed, and the riding comfort of the operator can be improved.

Another Embodiment

In the following, another embodiment will be described. In this embodiment, the state determination unit 301 of the controller 30 determines the state of a traveling surface, based on image data and the hardness of the traveling surface.

Specifically, the state determination unit 301 according to the present embodiment refers to image data of a traveling surface captured by the imaging device S6 and a detection result of the hardness of the traveling surface, to determine that the state of the traveling surface is a rough state (first state) in the case where an image of the traveling surface represented by the image data and the hardness of the traveling surface represented by the detection result satisfy a predetermined condition.

Note that although the image data is assumed to be image data of the traveling surface imaged by the imaging device S6, it is not limited as such. The image data simply needs to be image data obtained by capturing the traveling surface, and may be image data captured by an imaging device provided outside the excavator 100.

Figure 8:
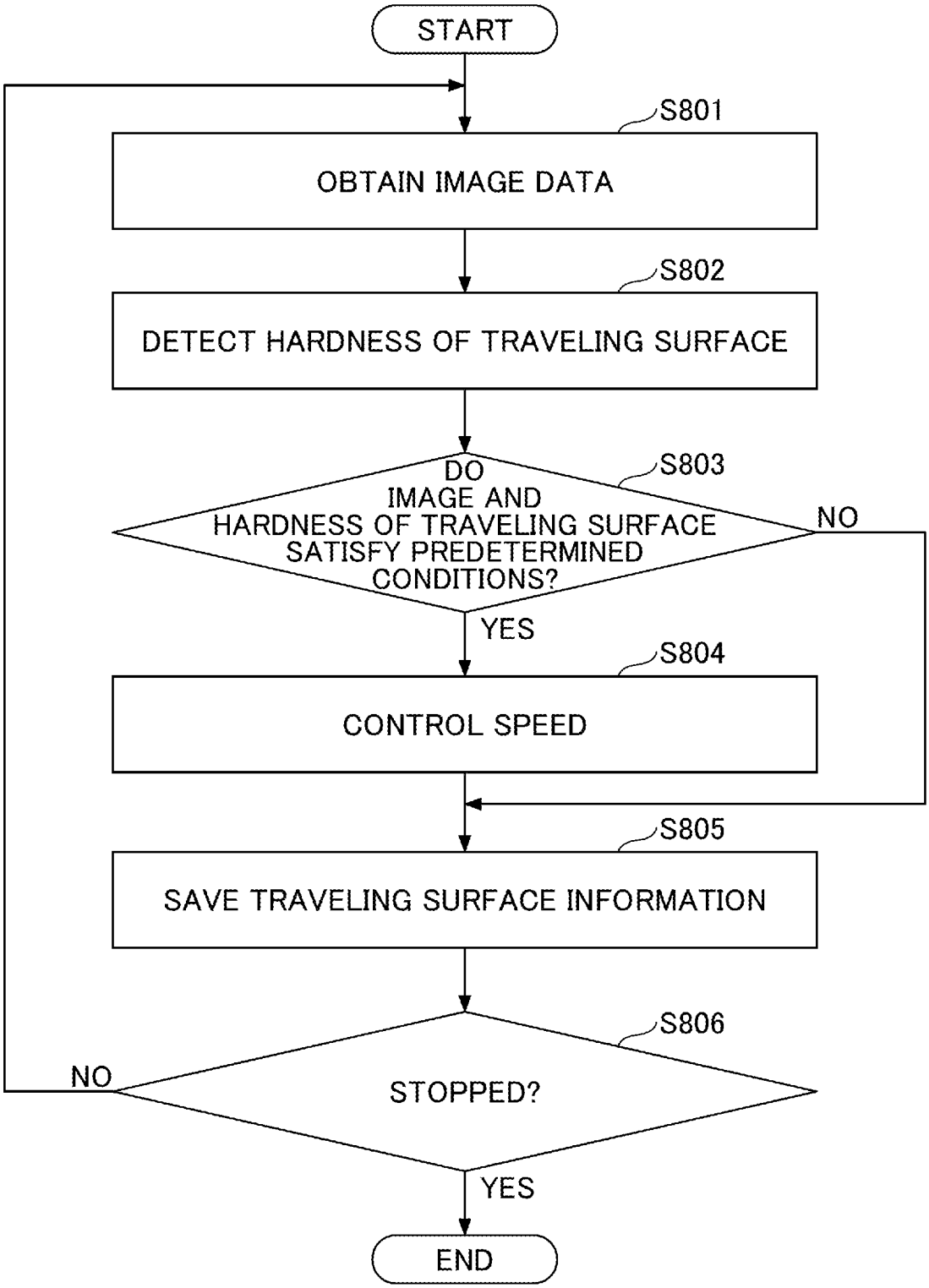
FIG. 8 is a flow chart illustrating operations of an excavator according to another embodiment.

In the following, with reference to FIG. 8, operations of the excavator 100 according to the present embodiment will be described. FIG. 8 is a flow chart illustrating operations of an excavator according to another embodiment.

The excavator 100 obtains the image data of the traveling surface from the imaging device S6 by the state determination unit 301 of the controller 30 (Step S801). Note that the image data obtained here may be image data of the traveling surface captured by the forward camera S6F that captures images of a space in front of the excavator 100, before the excavator 100 starts traveling.

Next, the controller 30 detects the hardness of the traveling surface by the state determination unit 301 (Step S802). Here, before the excavator 100 starts traveling, the traveling surface is excavated by the bucket 6, and the hardness of the traveling surface is determined according to the lowering speed of the teeth end of the bucket 6 when excavation is executed.

Specifically, the state determination unit 301 detects the rotation angle of the arm 5 detected by the arm angle sensor S2 and the cylinder pressure detected by the cylinder pressure sensor. In addition, the state determination unit 301 according to the present embodiment may detect the hardness of the traveling surface in stages based on respective threshold values set for the rotation angle of the arm 5 and for the cylinder pressure.

Next, the state determination unit 301 determines whether the image represented by the image obtained from the imaging device S6 and the hardness of the traveling surface detected at Step S802 satisfy the predetermined condition (Step S803).

The predetermined condition is, for example, that the hardness of the traveling surface is greater than or equal to than a certain hardness and that unevenness of the traveling surface is detected from the image.

At Step S803, if the image and the hardness of the traveling surface do not satisfy the predetermined condition, the controller 30 proceeds to Step S805 that will be described later.

The case where the predetermined condition is not satisfied is, for example, a case where unevenness of the traveling surface is detected from the image but the hardness of the traveling surface is less than a certain hardness, a case where the hardness of the traveling surface is greater than or equal to the certain hardness but unevenness is not detected from the image, or the like.

At Step S803, if the image and the hardness of the traveling surface satisfy the predetermined condition, the controller 30 proceeds to Step S804. The processing from Step S804 to Step S806 in FIG. 8 is substantially the same as the processing from Step S603 to Step S605 in FIG. 6; therefore, description of these steps are omitted.

In this way, in the present embodiment, based on the image data obtained by the imaging device S6 of the excavator 100 and the hardness of the traveling surface, the state of the traveling surface can be detected, and the traveling speed of the excavator 100 can be controlled according to the state of the traveling surface. Therefore, according to the present embodiment, the swing of the body can be suppressed, and the riding comfort of the operator can be improved. Note that although the controller 30 is installed on the excavator 100 in the embodiment described above, the controller 30 may be installed outside the excavator 100. In this case, the controller 30 may be, for example, a control device installed in a remote control room. In this case, the display device 40 may be connected to the control device provided in the remote control room. In addition, the control device installed in the remote control room may receive output signals from various sensors attached to the excavator 100, to determine the state of the traveling surface and the degree of roughness of the traveling surface. In addition, for example, in the embodiment described above, the display device 40 may function as a display unit in the support device 300. In this case, the support device 300 may be connected to the controller 30 of the excavator 100 or the controller installed in the remote control room.

Another Embodiment

In the following, yet another embodiments will be described. In the present embodiment, in the management device 200, the map information is generated using the traveling surface information received from the excavator 100.

Figure 9:
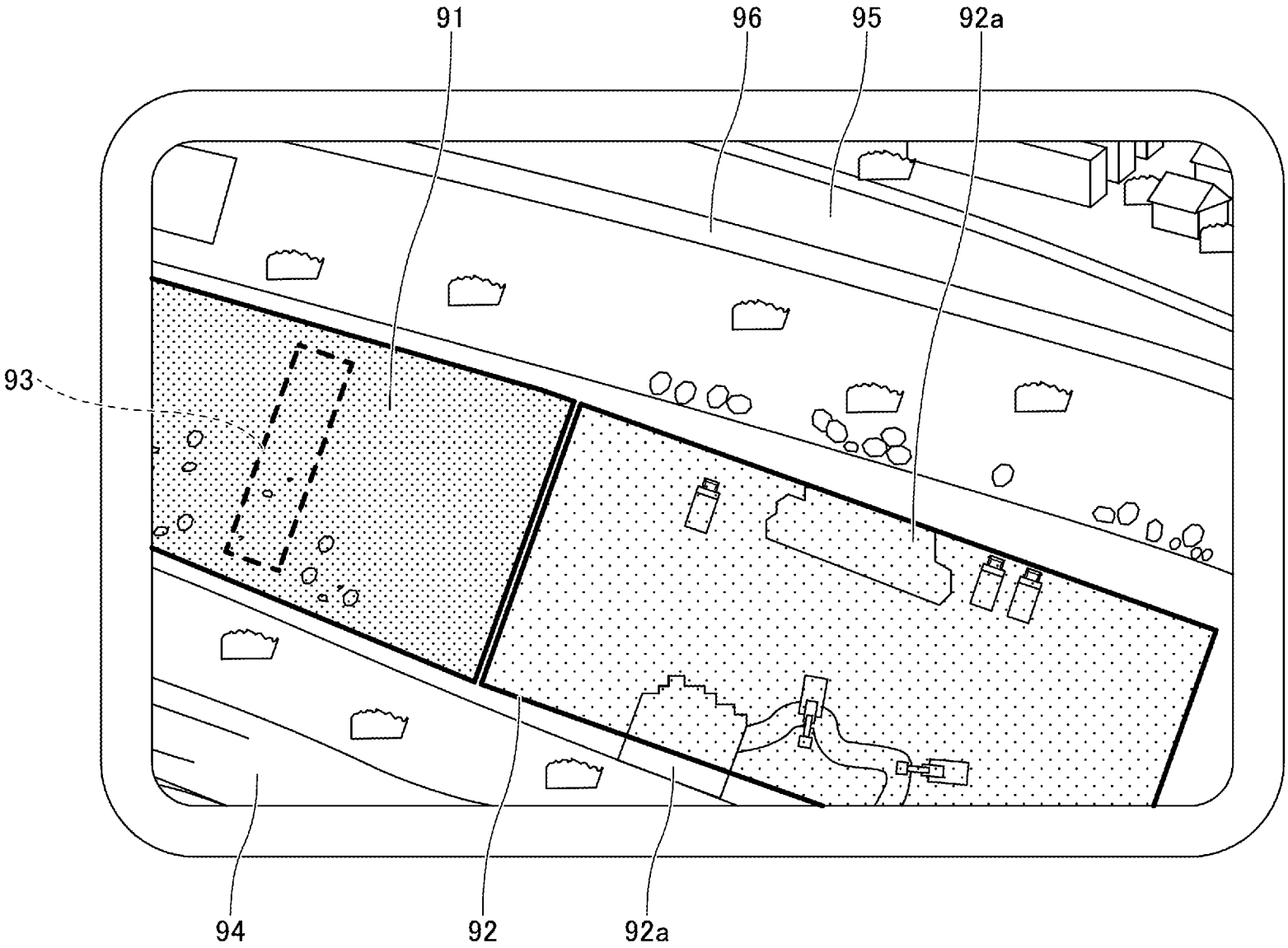
FIG. 9 is a diagram illustrating generation of map information by a management device.

FIG. 9 is a diagram illustrating generation of map information by a management device. The management device 200 according to the present embodiment generates the map information in which the traveling surface information received from the excavator 100 is associated with the map information.

FIG. 9 illustrates an example in which, for example, an image obtained by capturing from above a riverbed including a work area where work is to be executed by the excavator 100 is displayed on a display device such as the management device 200.

The image displayed on the display device is an image of a riverbed including an area 91 having a rough traveling surface and an area 92 having a smooth traveling surface, and also includes images of a river 94, a bank 95, and a road 96 on the bank.

The area 91 includes a work area 93 in which the excavator 100 works. In the work area 93, for example, a work of burying a water channel for passing water to the river may be executed. In the area 92, for example, a material yard 92*a* or the like is provided.

In the case where the excavator 100 is traveling in the area 91, the management device 200 receives the traveling surface information that includes the positional information on the excavator 100 and information indicating that the traveling surface is rough, from the excavator 100.

In addition, in the case where the excavator 100 is traveling in the area 92, the management device 200 receives the traveling surface information that includes the positional information on the excavator 100, and information indicating that the traveling surface is flat (smooth), from the excavator 100.

In response to receiving the traveling surface information including the positional information and a determination result of the state of the traveling surface in this way, the management device 200 generates map information in which the traveling surface information is associated with map information identified from the positional information.

Figure 10:
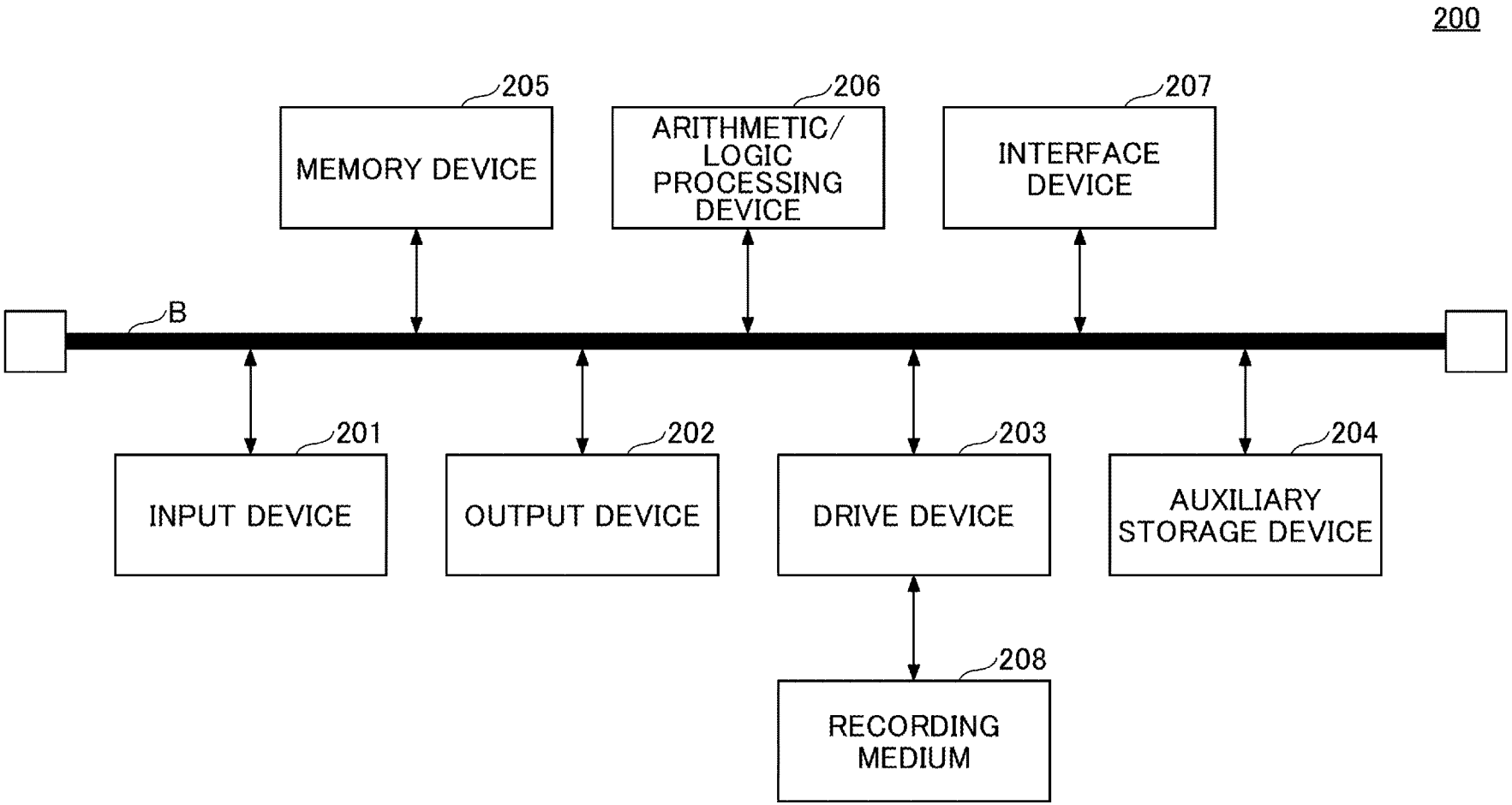
FIG. 10 is a diagram illustrating an example of a hardware configuration of a management device.

In the following, with reference to FIG. 10, a hardware configuration of the management device 200 according to the present embodiment will be described. FIG. 10 is a diagram illustrating an example of a hardware configuration of a management device.

The management device 200 according to the present embodiment is a computer that includes an input device 201, an output device 202, a drive device 203, an auxiliary storage device 204, a memory device 205, an arithmetic/logic processing device 206, and an interface device 207, which are connected to each other via a bus B.

The input device 201 is a device for inputting various items of information, and is implemented by, for example, a touch panel, a keyboard, or the like. The output device 202 is a device for outputting various items of information, and is implemented by, for example, a display or the like. The interface device 207 is used for connecting to a network.

A map generation program implemented by units that will be described later is at least part of various programs for controlling the management device 200. The map generation program is provided by, for example, distribution of a recording medium 208, downloading from the network, or the like. As the recording medium 208 in which the map generation program is recorded, various types of storage media can be used, such as a recording medium in which information is optically, electrically, or magnetically recorded, a semiconductor memory in which information is electrically recorded such as a ROM or a flash memory, and the like.

In addition, once the recording medium 208 storing the map generation program is set in the drive device 203, the map generation program is installed from the recording medium 208 into the auxiliary storage device 204 via the drive device 203. The map generation program downloaded from the network is installed in the auxiliary storage device 204 via the interface device 207.

The auxiliary storage device 204 stores the map generation program installed in the management device 200, and also stores the map information generated by executing the map generation program, various files and data required by the management device 200, and the like. The memory device 205 reads and stores the map generation program from the auxiliary storage device 204 when the management device 200 is activated. In addition, the arithmetic/logic processing device 206 implements various processes to be described later according to the map generation program stored in the memory device 205.

Figure 11:
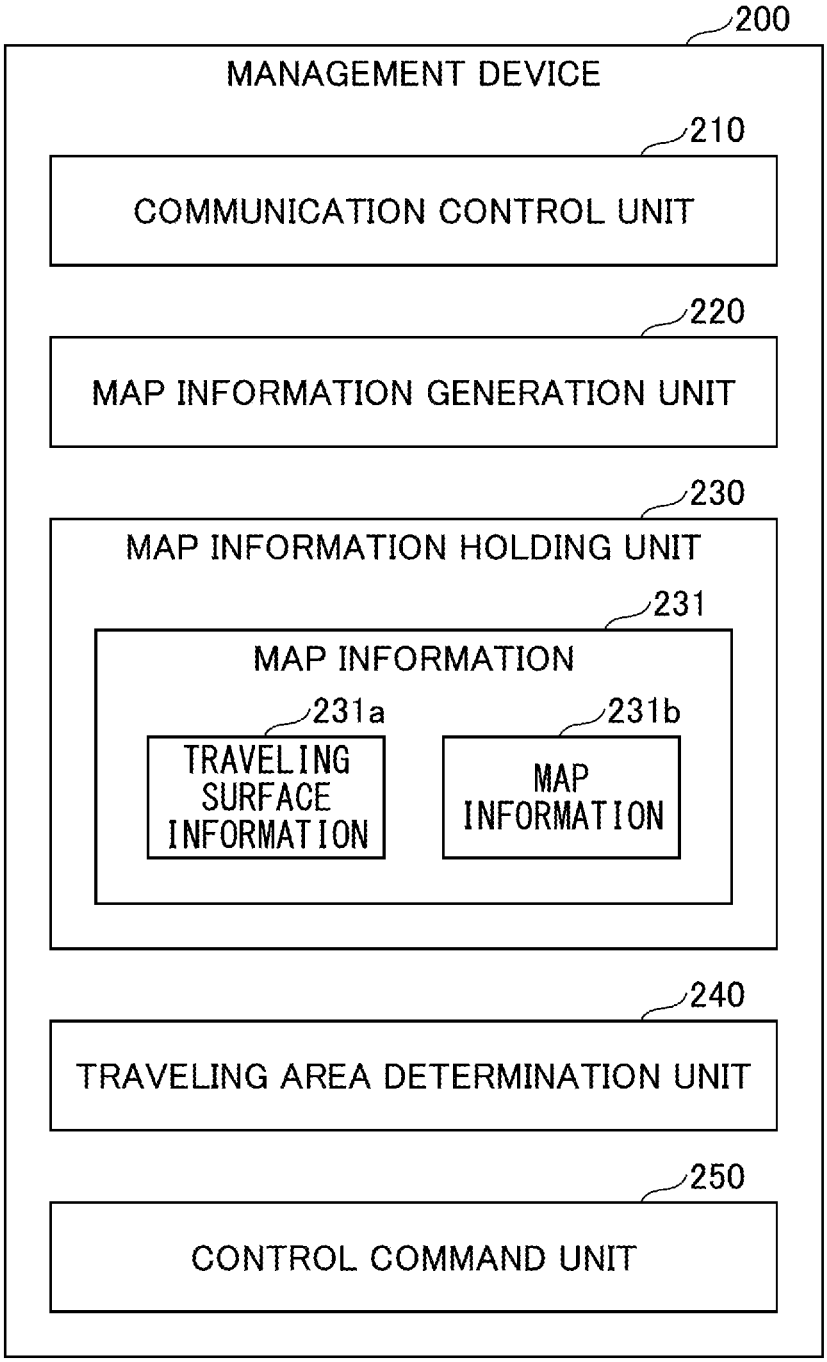
FIG. 11 is a diagram illustrating functions of the management device.

Next, with reference to FIG. 11, functions of the management device 200 according to the present embodiment will be described. FIG. 11 is a diagram illustrating functions of the management device.

The management device 200 according to the present embodiment includes a communication control unit 210, a map information generation unit 220, a map information holding unit 230, a traveling area determination unit 240, and a control command unit 250.

The communication control unit 210 controls transmission and reception of information to and from external devices including the excavator 100.

The map information generation unit 220 generates map information, by using the traveling surface information received by the communication control unit 210 from the excavator 100. Specifically, based on the positional information included in the traveling surface information, the map information generation unit 220 identifies map information on an area including the positional information.

The map information may be obtained from, for example, an external server on the network.

Next, the map information generation unit 220 associates the obtained map information with the traveling surface information, to generate map information.

Note that for example, the map information generation unit 220 according to the present embodiment may identify the map information, based on an area indicated by items of positional information included in the traveling surface information received multiple times during a certain period.

The map information holding unit 230 holds the map information 231 generated by the map information generation unit 220. The map information 231 is information in which the traveling surface information 231*a* is associated with the map information 231*b*. In other words, the map information 231 is information including information that indicates the state of the traveling surface in the area indicated by the map information. In addition, the map information 231 may be, for example, construction planning drawings.

In addition, other than the traveling surface information 231*a* and the map information 231*b*, the map information 231 of the present embodiment may also include information that represents the soil quality of the area indicated by the map information, information that represents the shape of the traveling surface and presence or absence of a slope. Note that the traveling surface information 231*a* according to the present embodiment may include information that represents the degree of roughness of the traveling surface.

In addition, in the present embodiment, although the management device 200 is assumed to be a device that generates and holds the map information in which the map information is associated with the traveling surface information, it is not limited as such. The management device 200 may hold the traveling surface information as the map information.

Based on the positional information received from the excavator 100 and the map information, the traveling area determination unit 240 determines the state of the traveling surface in the area where the excavator 100 that transmitted the positional information is traveling.

The control command unit 250 instructs the excavator 100 to execute speed control according to the determination result of the traveling area determination unit 240. Specifically, in the case where the traveling area determination unit 240 determines that the traveling surface of the area in which the excavator 100 is traveling is rough, the control command unit 250 transmits a command to switch to a work mode in which the excavator 100 travels at a lower speed, via the communication control unit 210.

Figure 12:
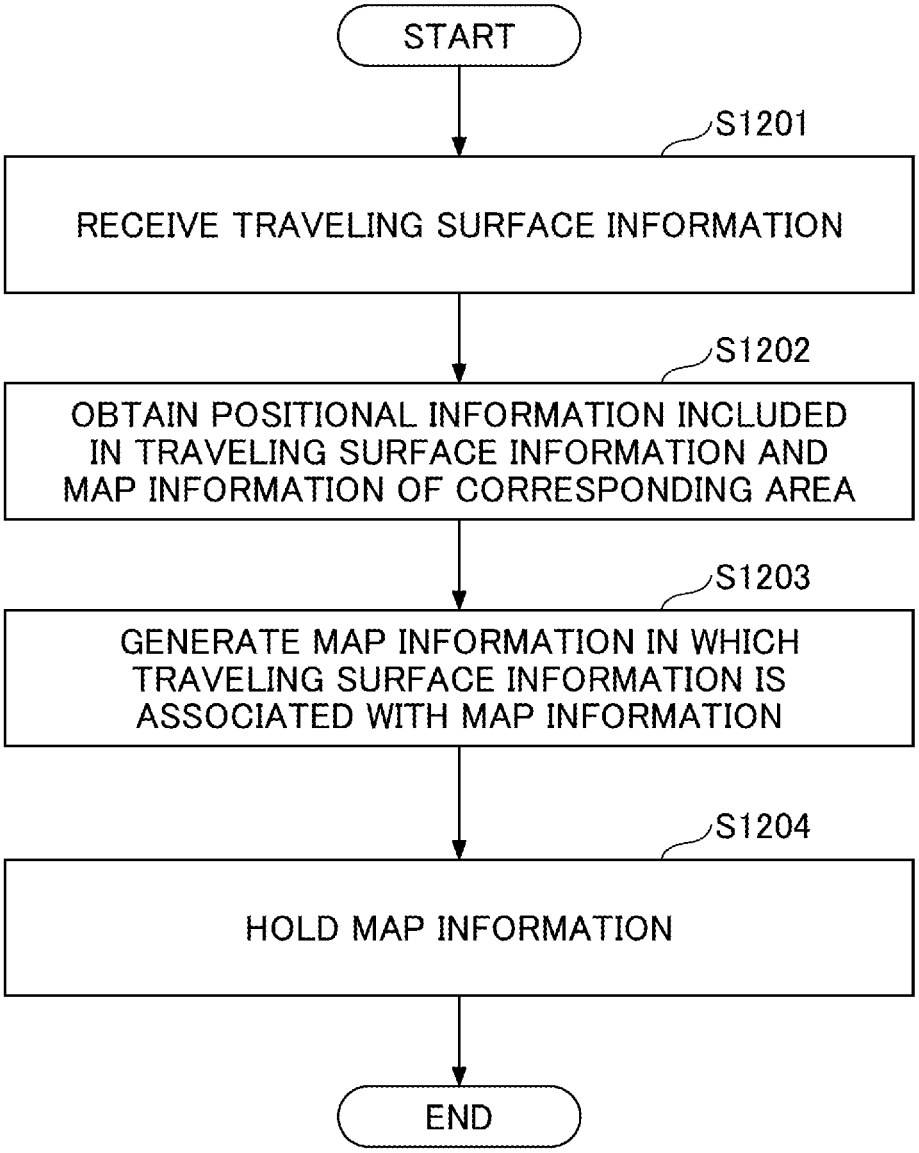
FIG. 12 is a first flow chart illustrating operations of the management device.

Next, with reference to FIGS. 12 and 13, operations of the management device 200 according to the present embodiment will be described. FIG. 12 is a first flow chart illustrating operations of the management device. FIG. 12 illustrates a process of generating map information by the management device 200.

The management device 200 according to the present embodiment receives the traveling surface information from the excavator 100 by the communication control unit 210 (Step S1201). Next, the management device 200 obtains the map information on an area corresponding to the positional information included in the traveling surface information, by the map information generation unit 220 (Step S1202). Note that the map information may be obtained from an external server on the network via the communication control unit 210.

Next, the map information generation unit 220 generates map information in which the map information obtained at Step S1202 is associated with the traveling surface information (Step S1203). Next, the management device 200 causes the map information holding unit 230 to hold the generated map information 231 (Step S1204), and ends the process.

Figure 13:
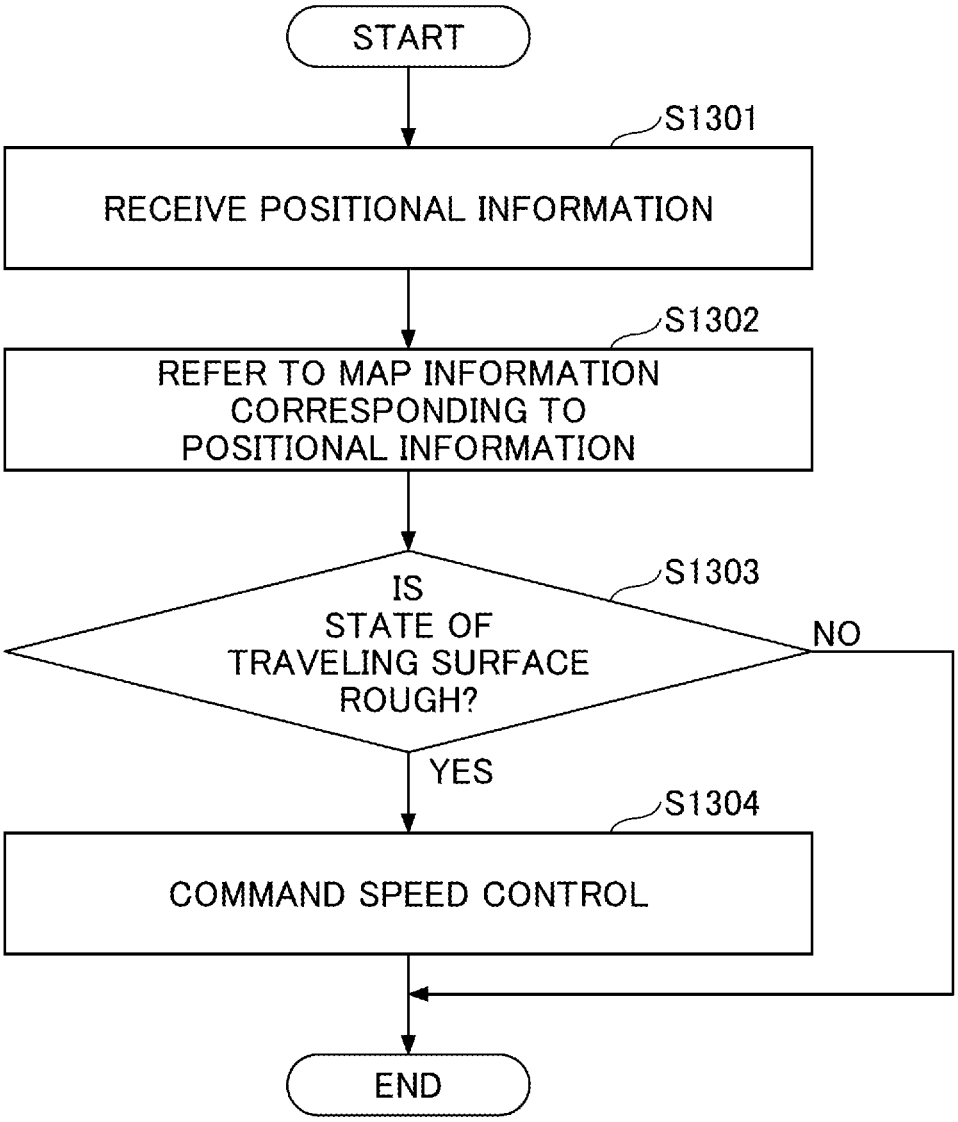
FIG. 13 is a second flow chart illustrating operations of the management device.

FIG. 13 is a second flow chart illustrating operations of the management device. FIG. 13 illustrates a process of determining the state of the traveling surface of the excavator 100, and a process of controlling the speed of the excavator 100 by the management device 200.

The management device 200 according to the present embodiment receives the positional information from the excavator 100 by the communication control unit 210 (Step S1301).

Next, the management device 200 refers to the map information 231 held in the map information holding unit 230 by the traveling area determination unit 240 (Step S1302), to determine the state of the traveling surface in the area indicated by the positional information (Step S1303).

Specifically, for example, the traveling area determination unit 240 identifies map information that includes map information including the position indicated by the positional information, from the map information 231 held in the map information holding unit 230. In addition, the traveling area determination unit 240 sets the state of the traveling surface indicated by the traveling surface information included in the identified map information as the state of the traveling surface of the excavator 100 that has received the positional information.

At Step S1303, in the case where the state of the traveling surface is determined to be a flat state, the management device 200 ends the process.

In addition, at Step S1303, in the case where the state of the traveling surface is determined to be a rough state, the management device 200 instructs the excavator 100 that has received the positional information to control the speed by the control command unit 250 (Step S1304), and ends the process.

In the present embodiment, in this way, in the management device 200, by determining the state of the traveling surface on which the excavator 100 travels, the processing load on the controller 30 of the excavator 100 can be reduced.

In addition, according to the present embodiment, the map information is held in the management device 200; therefore, the map information can be shared by multiple excavators 100. In addition, according to the present embodiment, the excavator 100 can cause the excavator 100 to travel at a speed corresponding to the state of the traveling surface even in an area where the excavator 100 has never traveled.

Note that in the present embodiment, although it is assumed that a speed control command is transmitted to the excavator 100 according to the determination result of the state of the traveling surface by the management device 200, it is not limited as such. The information including the determination result of the state of the traveling surface and the contents of the command to the excavator 100 transmitted from the management device 200 may also be transmitted to the support device 300.

On the support device 300, by displaying the information received from the management device 200 on the display unit, it is possible to notify the state of the traveling surface to a worker other than the operator of the excavator 100 at the work site.

In addition, in the present embodiment, for example, on the support device 300, when the information identifying the position of the work site is input and transmitted to the management device 200, the management device 200 may refer to the map information 231 and transmit the map information on the area corresponding to the work site to the support device 300.

The support device 300 displays the map information received from the management device 200. At this time, for example, as illustrated in FIG. 9, the map information may display an image identifying an area where the traveling surface is rough and an image identifying an area where the traveling surface is flat in an area that indicates the entire work site.

In other words, on the support device 300, the map information may be displayed such that an area in which the traveling speed needs to be limited is distinguished from an area in which the traveling speed does not need to be limited in the work site.

In this way, by displaying the map information on the support device 300, it is possible to cause a worker who works in the work site to visually grasp the state of the traveling surface of the entire work site.

As above, the embodiments have been described with reference to specific examples. However, the present invention is not limited to these specific examples. Appropriate design changes made to these specific examples by those skilled in the art are also included in the scope of the present invention as long as including the features of the present invention. Elements included in the specific examples described above and the arrangement, condition, shape, and the like of the elements are not limited to those exemplified and can be changed appropriately. The elements included in the specific examples described above may be appropriately combined as long as no technical contradiction occurs.

The invention claimed is:

1. An excavator comprising:

a traveling body;

a traveling hydraulic motor configured to drive the traveling body; and a hardware processor configured to, during traveling of the excavator, automatically determine roughness of a traveling surface on which the traveling body travels, and control the traveling hydraulic motor according to the determined roughness, wherein the hardware processor is further configured to determine the roughness of the traveling surface in response to determining that unevenness of the traveling surface has a height difference smaller than a height of a crawler belt of the traveling body.

2. The excavator as claimed in claim 1, further comprising:

an acceleration sensor, wherein the hardware processor is configured to determine the roughness of the traveling surface, based on an amplitude value of acceleration detected by the acceleration sensor.

3. The excavator as claimed in claim 2, wherein the hardware processor is configured to reduce a traveling speed in response to the amplitude value of acceleration becoming greater than or equal to a predetermined threshold.

4. The excavator as claimed in claim 2, wherein the hardware processor is configured to determine that the traveling surface is rough when the traveling hydraulic motor needs to be controlled by the hardware processor and that the traveling surface is smooth when the traveling hydraulic motor does not need to be controlled by the hardware processor.

5. The excavator as claimed in claim 2, wherein the hardware processor is configured to determine that the traveling surface is rough in response to determining that the amplitude value of acceleration is greater than or equal to a predetermined threshold.

6. The excavator as claimed in claim 1, wherein the hardware processor is configured to determine the roughness of the traveling surface, based on image data obtained by imaging the traveling surface and hardness of the traveling surface.

7. The excavator as claimed in claim 6, wherein the hardware processor is configured to reduce a traveling speed in response to determining that an image of the traveling surface indicated by the image data and the hardness of the traveling surface satisfy a predetermined condition.

8. The excavator as claimed in claim 7, wherein the hardware processor is configured to determine that the image of the traveling surface indicated by the image data and the hardness of the traveling surface satisfy the predetermined condition when unevenness of the traveling surface is detected from the image and the hardness is greater than or equal to a predetermined hardness.

9. The excavator as claimed in claim 6, wherein the hardware processor is configured to determine that the traveling surface is rough in response to determining that an image of the traveling surface indicated by the image data and the hardness of the traveling surface satisfy the predetermined condition.

10. The excavator as claimed in claim 9, wherein the hardware processor is configured to determine that the image of the traveling surface indicated by the image data and the hardness of the traveling surface satisfy the predetermined condition when unevenness of the traveling surface is detected from the image and the hardness is greater than or equal to a predetermined hardness.

11. The excavator as claimed in claim 1, further comprising:

a storage, wherein the hardware processor is configured to obtain positional information that represents a position of the excavator at which the hardware processor determines the roughness of the traveling surface, generate traveling surface information in which the obtained positional information and information that represents the determined roughness are associated with each other, and store the generated traveling surface information in the storage.

12. The excavator as claimed in claim 11, wherein the hardware processor is configured to control the traveling hydraulic motor based on information that represents the position of the excavator and the traveling surface information stored in the storage.

13. The excavator as claimed in claim 11, wherein the hardware processor is configured to generate the traveling surface information in which the obtained positional information, information that represents the determined roughness, and speed information that represents a traveling speed of the excavator after the traveling hydraulic motor is controlled are associated with each other.

14. The excavator as claimed in claim 1, wherein the hardware processor is configured to determine the roughness of the traveling surface according to sizes of stones present on a ground as the traveling surface.

15. The excavator as claimed in claim 1, wherein the hardware processor is configured to determine whether the traveling surface is rough based on the determined roughness of the traveling surface, and reduce a traveling speed of the excavator by controlling the traveling hydraulic motor, in response to determining that the traveling surface is rough.

16. An excavator support system, comprising:

the excavator as set forth in claim 1; and a management device of excavators, the management device including a hardware processor, wherein the hardware processor of the excavator is further configured to transmit, to the management device, traveling surface information in which positional information that represents a position of the excavator at which the hardware processor of the excavator determines the roughness of the traveling surface is associated with information that represents the determined roughness, and wherein the hardware processor of the management device is configured to, during traveling of another excavator, automatically store the traveling surface information received from the excavator, determine roughness of a traveling surface on which another excavator is travels, based on positional information received from said another excavator and the stored traveling surface information, and transmit a control command for a traveling hydraulic motor of said another excavator to said another excavator according to the determined roughness of the traveling surface on which said another excavator travels.

17. The excavator support system as claimed in claim 16, wherein the hardware processor of the management device is configured to generate first map information in which the traveling surface information received from the excavator is associated with second map information identified from the positional information included in the received traveling surface information, and during traveling of said another excavator, automatically determine the roughness of the traveling surface on which said another excavator travels based on the positional information received from said another excavator and the generated first map information.

18. An excavator comprising:

a traveling body;

a traveling hydraulic motor configured to drive the traveling body;

a revolving body installed on the traveling body and configured to revolve relative to the traveling body;

an attachment attached to the revolving body, the attachment including an arm and a bucket attached to the arm as an end attachment; and a hardware processor configured to, during traveling of the excavator, automatically determine roughness of a traveling surface on which the traveling body travels, and control the traveling hydraulic motor according to the determined roughness, wherein the hardware processor is configured to determine the roughness of the traveling surface, based on image data obtained by imaging the traveling surface and hardness of the traveling surface, and wherein the hardware processor is configured to, before the excavator starts traveling, move the bucket to excavate the traveling surface and determine the hardness of the traveling surface according to lowering speed of a teeth end of the bucket when the bucket excavates the traveling surface.

19. The excavator as claimed in claim 18, further comprising:

a hydraulic cylinder configured to drive the arm;

an angle sensor configured to detect a rotation angle of the arm; and a pressure sensor configured to detect a pressure of the hydraulic cylinder, wherein the hardware processor is configured to determine the hardness of the traveling surface in stages based on the detected rotation angle, the detected pressure, and thresholds set for the detected rotation angle and the detected pressure.

* * * * *